US008742680B2

(12) United States Patent
Cowburn

(10) Patent No.: US 8,742,680 B2
(45) Date of Patent: Jun. 3, 2014

(54) LIGHTING CONTROL SYSTEM

(71) Applicant: Lumen Cache, Inc., Indianapolis, IN (US)

(72) Inventor: Derek Cowburn, McCordsville, IN (US)

(73) Assignee: Lumen Cache, Inc, Indianapolis, IN (US)

( * ) Notice: Subject to any disclaimer, the term of this patent is extended or adjusted under 35 U.S.C. 154(b) by 3 days.

(21) Appl. No.: 13/712,904

(22) Filed: Dec. 12, 2012

(65) Prior Publication Data

US 2013/0147367 A1 Jun. 13, 2013

Related U.S. Application Data

(60) Provisional application No. 61/671,779, filed on Jul. 15, 2012, provisional application No. 61/569,324, filed on Dec. 12, 2011.

(51) Int. Cl.

| | |
|---|---|
| ***G09G 1/04*** | (2006.01) |
| ***H01J 29/70*** | (2006.01) |
| ***H01J 29/72*** | (2006.01) |

(52) U.S. Cl.

USPC ..... 315/288; 315/152; 315/132; 315/317; 315/318

(58) Field of Classification Search

None

See application file for complete search history.

(56) References Cited

U.S. PATENT DOCUMENTS

| | | | | |
|---|---|---|---|---|
| 7,259,683 | B2 | 8/2007 | Abe | |
| 7,598,686 | B2 * | 10/2009 | Lys et al. | 315/312 |
| 8,058,750 | B2 | 11/2011 | Covaro et al. | |
| 8,159,156 | B2 | 4/2012 | Henig et al. | |
| 2008/0165535 | A1 * | 7/2008 | Mazzochette | 362/294 |
| 2008/0290251 | A1 | 11/2008 | Deurenberg et al. | |
| 2009/0079357 | A1 | 3/2009 | Shteynberg et al. | |
| 2010/0301754 | A1 | 12/2010 | Bakre et al. | |
| 2011/0273108 | A1 * | 11/2011 | Sivertsen | 315/250 |
| 2012/0120633 | A1 | 5/2012 | Hillman et al. | |
| 2012/0133636 | A1 | 5/2012 | Kita | |
| 2012/0269520 | A1 | 10/2012 | Hong et al. | |

OTHER PUBLICATIONS

WIPO PCT Search Report for PCT/US12/069311 filed Dec. 12, 2012; Applicant Lumen Cache, Inc., Feb. 20, 2013. Corresponding PCT case.

* cited by examiner

*Primary Examiner* — Anh Tran

(74) *Attorney, Agent, or Firm* — E. Victor Indiano; Indiano Law Group, LLC

(57) ABSTRACT

A control system controls the operation of at least a first and a second independently controllable LED light member. The control system includes a frame member on which a plurality of electrical components can be mounted, and at least one input port for receiving at least one of a power source and a command signal source capable of sending a command signal to at least one of the first and second LED light members. A first driver member is provided for conducting power to deliver conditioned DC power to the first LED member. A first driver to frame connector removably couples the first driver member to the frame member. A second driver member conditions power to deliver conditioned DC power to the second LED member, and a second driver to frame connector removably couples the first driver member to the frame member. A first external output port is coupled to the first driver, and a second external output port coupled to the second driver. A first multi-channel electrical conductor is coupled to the first external output port for conducting conditioned DC current to the first LED light member; and a second multi-channel electrical conductor conducts conditioned DC current to the second LED light member.

17 Claims, 24 Drawing Sheets

- CAT5 TO CONTROL MODULE
- 22/2 TO FIXTURE

- CAT5 TO CONTROL MODULE
- 22/2 TO FIXTURE

- CAT5 TO CONTROL MODULE
- 22/2 TO FIXTURE

- CAT5, 22/2 OR 18/4 TO FIXTURE

- CAT5 TO CONGTROL PADS
- CAT5 TO SENSORS

LIGHTING CONTROL SYSTEM

PRIORITY CLAIMS

This Provisional application is related to, and claims benefit to Derek Cowburn, U.S. Provisional Patent Application Ser. No. 61/569,324 that was filed on 12 Dec. 2011 and Derek Cowburn, U.S. Provisional Patent Application Ser. No. 61/671,779 that was filed on 15 Jul. 2012, both of which are fully incorporated by reference herein.

I. TECHNICAL FIELD OF THE INVENTION

The present invention relates to lighting control systems, and more particularly, to a lighting control system that is especially adaptable for use with DC current driven lighting systems, such as LED lights.

II. BACKGROUND OF THE INVENTION

There are several types of building lighting systems in widespread use. Incandescent lighting systems are widely used currently. In an incandescent light AC current is passed through a filament housed in a vacuum bulb. The filament glows and gives off light.

Incandescent light bulbs also have a drawback as they burn hot, and are inefficient in their use of power when compared to florescent lights. Because of the inherent inefficiency, incandescent light bulbs are falling into disfavor.

Another popular lighting system employs a florescent light system. Florescent light systems employ a gas-filled sealed tube. By passing current through the gas, the gas is caused to glow, to thereby give of light. Florescent lights, while highly popular, also have drawbacks. Florescent lights raise health and/or environmental concerns, since florescent lights typically include mercury that is highly poisonous and creates an environmental hazard.

Another difficulty is that the light given off by most florescent lights is a very "cool" (blush) light that, while doing a fine job to illuminate a space, does not contain the warmer tones of an incandescent light bulb. Further, unlike incandescent lights, florescent lights are not well adapted to provide a variable light output, such as can be accomplished through a dimmer without additional circuitry that has a significant impact on the cost of the bulb.

It is noteworthy that AC current is normally used to drive both incandescent and florescent lights that are found in homes and commercial buildings. Because of the popularity of these lights, most buildings are designed to have 120 volt AC current delivered to the building or structure by an electric utility. The delivered current is then distributed within the structure as 120 volt AC current and in some cases, 240 volt AC current), in the United States. Within the building, the 120 volt AC current is delivered directly to rooms through wires, that are coupled to an incandescent or florescent light bulb, to thereby power the bulb. This arrangement works well since incandescent and florescent bulbs are best driven by such AC current, at least in the United States.

In addition to the incandescent and florescent bulb discussed above, other light bulbs exist that are used in certain applications, such as mercury vapor light bulbs, metal halide and other bulbs. These bulbs are also driven by alternating current.

Another, increasingly popular type of light bulb is an "LED bulb", since the light source primarily comprises a light emitting diode or LED. LED light bulbs are gaining favor because they are capable of providing a large amount of light and typically have a rather long life span. However, probably the most desirable feature of LED lights is that they provide a large amount of light with a very low amount of power consumption, and thus, are highly efficient, and inexpensive to operate since they require much less power than either an incandescent or florescent bulb. Some estimates suggest that even with the higher initial purchase cost, purchasing and operating an LED light will cost significantly less than an incandescent bulb, and about the same as a florescent bulb.

Currently, LED bulbs exist that are capable of being used in conventional housing systems and building systems. For example, LED bulbs exist that have a threaded base that can be threadedly engaged into a threaded light bulb socket of the type that currently houses an incandescent bulb.

There exists a significant difference in the way that LED light bulbs operate, when compared with most incandescent or florescent bulbs, as LED bulbs tend to be driven by DC current, rather than AC current. In order to accommodate this, currently existing LED bulbs often contain not only a bulb component (which may comprise from one to a large plurality of individual LED bulbs), but also a driver component. The driver is provided for converting alternating current into direct current so that the bulb can be powered by direct current.

One difficulty with the use of such driver-containing LED bulbs is that they can be expensive to replace. Since current "plug in an AC light socket" type LED bulbs include both a bulb and its chip-based driver, the price of the bulb reflects not only the cost of the bulb but also of the driver. It has been found by the Applicant that the bulb and the driver will often have different useful lives. However, since the bulb and the driver are combined in one inseparable unit, the useful life of the component with the shortest useful life typically governs the lifetime of the combined device, since, for example, when the driver burns out, the driver and bulb must be replaced as a unit. An additional issue relates to flexibility of the unit, since the driver and the bulb are combined.

Therefore, one object of the present invention is to provide a lighting device that improves upon current known devices.

III. SUMMARY OF THE INVENTION

In accordance with the present invention, a control system is provided for controlling the operation of at least a first and a second independently controllable LED light member. The control system comprises a frame member on which a plurality of electrical components can be mounted, and at least one input port for receiving at least one of a power source and a command signal source capable of sending a command signal to at least one of the first and second LED light members. A first driver member is provided for conducting power to deliver conditioned DC power to the first LED member. A first driver to frame connector removably couples the first driver member to the frame member. A second driver member conditions power to deliver conditioned DC power to the second LED member, and a second driver to frame connector removably couples the first driver member to the frame member. A first external output port is coupled to the first driver, and a second external output port coupled to the second driver. A first multi-channel electrical conductor is coupled to the first external output port for conducting conditioned DC current to the first LED light member; and a second multi-channel electrical conductor conducts conditioned DC current to the second LED light member.

One feature of the present invention is that it includes a DC current delivery system, wherein DC current is delivered to the drivers, and DC current is then conducted from the drivers to the bulbs and/or sensors that are located remotely from the drivers. This use of DC current from a DC source that is conducted all the way through the driver and bulb system has several advantages. One advantage is that it makes the wiring easier and potentially less expensive. Because of the low DC current that is being conducted, one can use both less expensive wire and less expensive labor by avoiding costs imposed by requiring specialized electricians to install the wiring. Many building codes permit low current DC wire to be installed in a house by lay personnel, such that electricians are not required.

Another feature of the use of DC current is that the DC current is highly capable of carrying not only electrical power, but also communication signals between the driver and the remotely located bulb. These communication signals can include such things as communication signals with a sensor that can report and sense conditions in the area adjacent to the bulbs, and communicate that information back through the DC circuit, both to the driver and from the driver to a central control unit that may comprise a computer circuit and accompanying software.

Another feature of the present invention is that the drivers are changeable independently of the bulbs and are located in a conveniently serviced location instead of at the light fixture. This feature provides enhanced reliability, lower costs, and greater flexibility.

With respect to enhanced cost-effectiveness, the ability of a user to change out a driver independently of the bulb tends to prolong the life of the system, and results in lower replacement costs. Since a driver and a bulb often have different useful lives, when a driver and bulb are coupled together, the failure of either the driver or the bulb forces the user to replace both the driver and the bulb. As a matter of logic, this reduces the useful length of the combined driver and bulb to the useful life of the shortest useful life component. However, by making the driver and the bulb separate, one can replace a bulb if it burns out before the driver, without being forced to replace the driver. The reverse is also true which thereby lowers replacement costs.

Additionally, since the present invention allows a single driver to control a plurality of bulbs, the initial purchase cost for a driver and bulb combination has the potential to be less than the prior art, wherein each bulb for each ganged set of bulbs) requires a separate driver.

Another advantage of the present invention lighting system relates to flexibility. For example, since driverless LED bulbs are less expensive than driver containing LED bulbs, one can replace bulbs more inexpensively. As new, higher efficiency luminary technologies are developed, they may be replaced without changing the driver components.

One additional feature of the present invention is that the Cat 5 wire can be used, that is both inexpensive to install, and is also capable of conveying not only power between the driver and the bulb or sensor, but information between the driver and the sensor product. This feature has an advantage of helping reduce the installation costs of the lighting wire, and also enabling the lighting wire to carry not only current, but also signal information between the driver and a sensor product or other component within the house.

These and other features and advantages of the present invention will become apparent to those skilled in the art upon a review of the drawings and detailed description presented below, that represent the best mode of practicing the invention perceived presently by the Applicant.

IV. DESCRIPTION OF DRAWINGS

Figure 6:
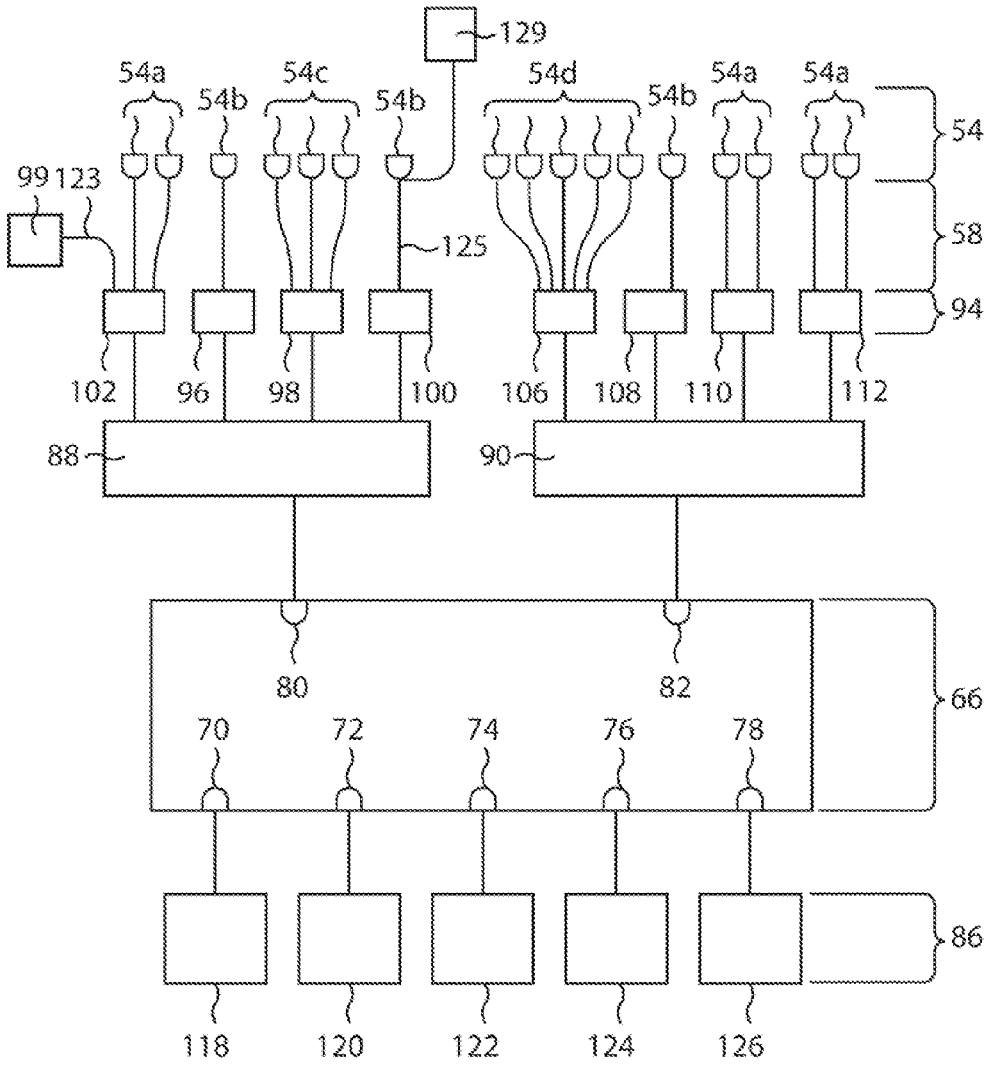

FIG. 6 is a schematic view of a controller, such as a regional controller 66 that is capable of receiving input from a variety of input sources 118-126, and is capable of providing output to a plurality of output sources, such as driver modules 90, driver cubes 112 and light fixtures.

Figure 7:
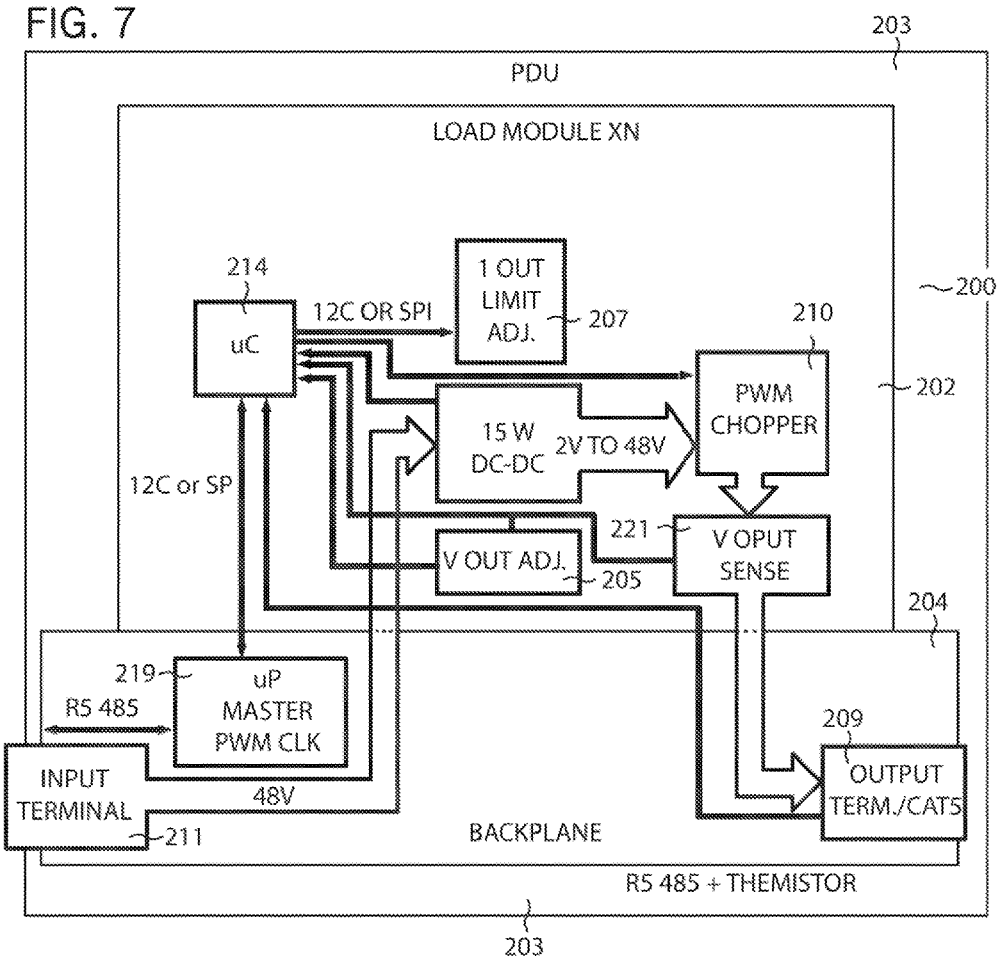

FIG. 7 is a schematic view of a power distribution module system 200 including a module 202 and a Power Distribution Unit (PDU) 203 having a backplane 204 having connector to which the module is connected. The power distribution module 200 comprises one of two power distribution module system architectures illustrating the modularization of the lighting level control 219 (located under communication bus 214) and failsafe control circuits (also a part of the component that serves as lighting level control 219); LED power management circuits including load out limit adjuster current 207; voltage out adjuster current 205, pulse width modulator (PWM) chopper 210,207,205,210, 221 Vout (Voltage out) Sensor and communication bus 214 for the Smart Cube module design where current management and Pulse Width Modulation (PWM) dimming are accomplished in the Load Modules 202.

Figure 8:
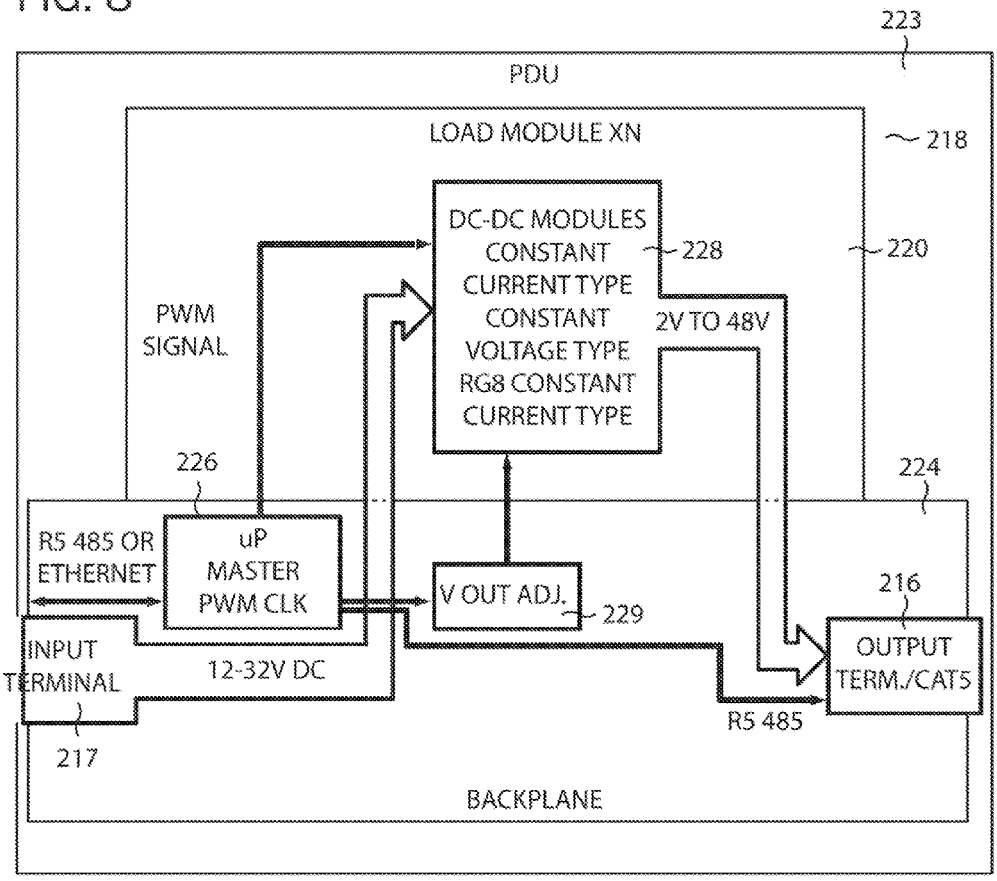

FIG. 8 is a schematic view of a second system architecture system 218 showing a module 220 and a Power Distribution Unit (PDU) 223 having a backplane 224. In this architecture the PWM (power width modulation) output of the Load Modules 220 are controlled directly from the PDU backplane circuit 226 and voltage out current 229 and only current or voltage control circuits 228 are contained in the Load Modules 220 with a current or voltage adjustment signal being sent from the backplane PDU 224 processor for each attached load module 220; and also showing output terminals 216 to LED Luminaries and an input terminal 217.

Figure 9:
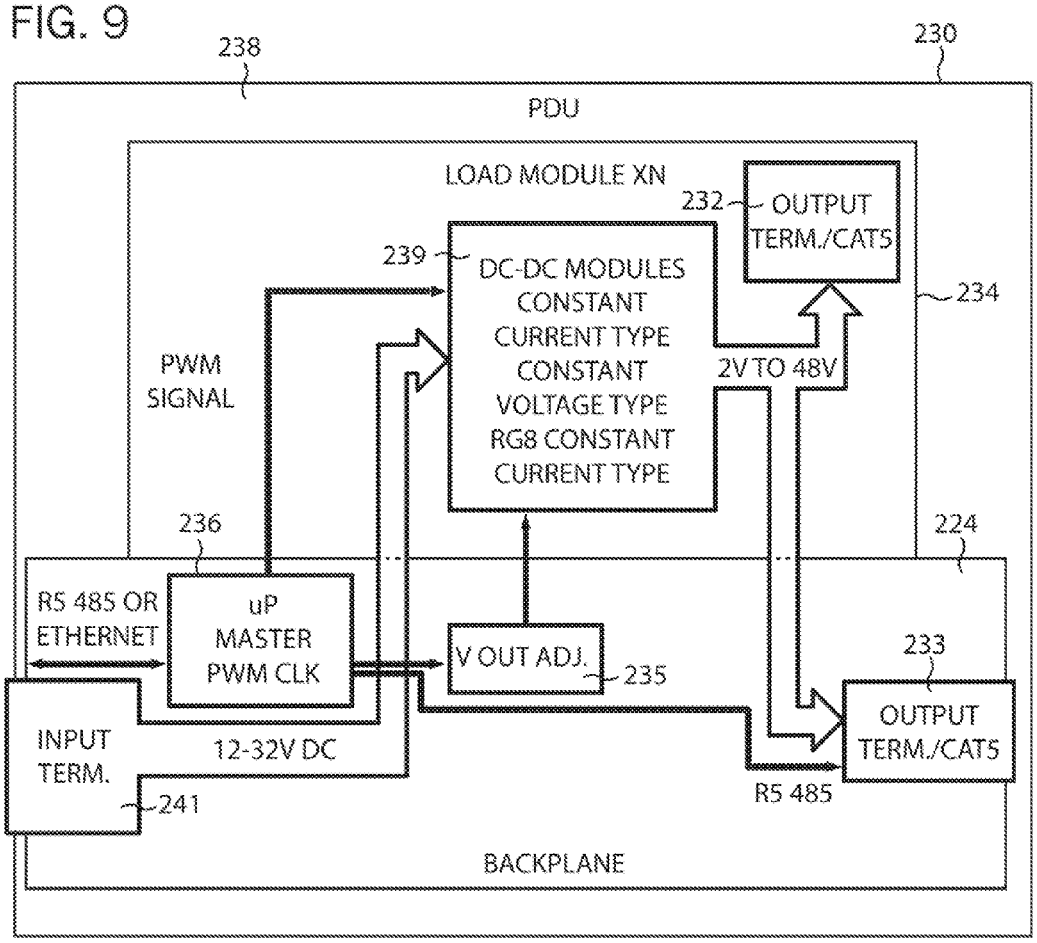
Figure 10:
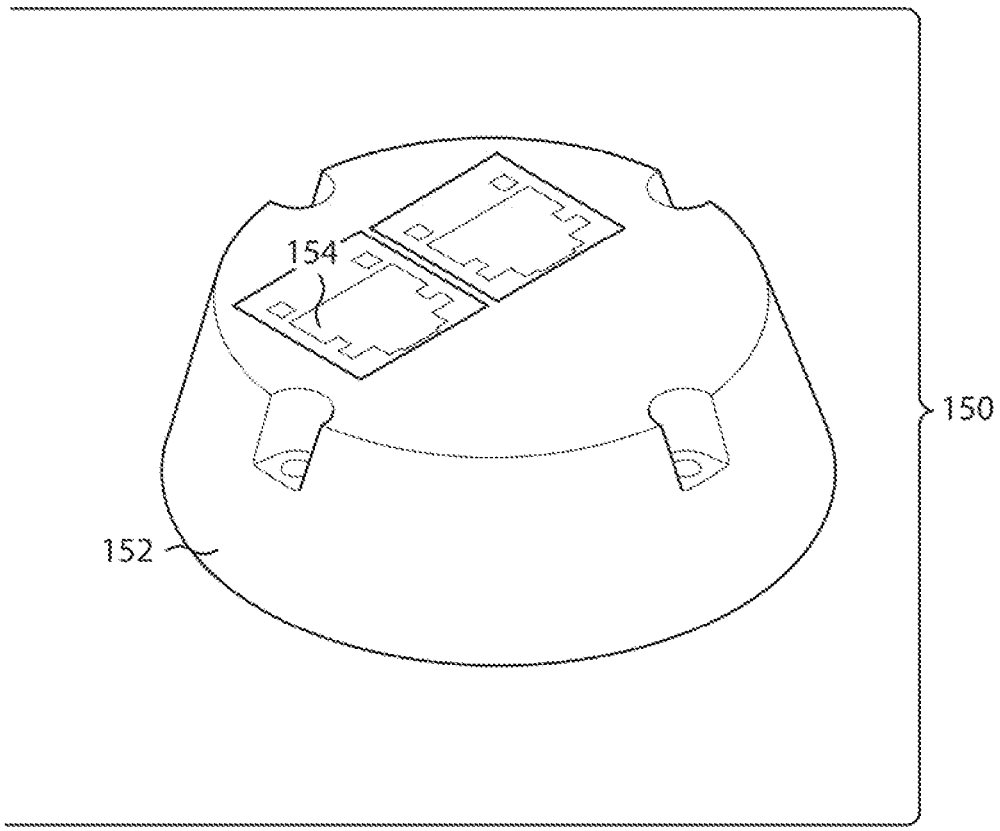
Figure 11:
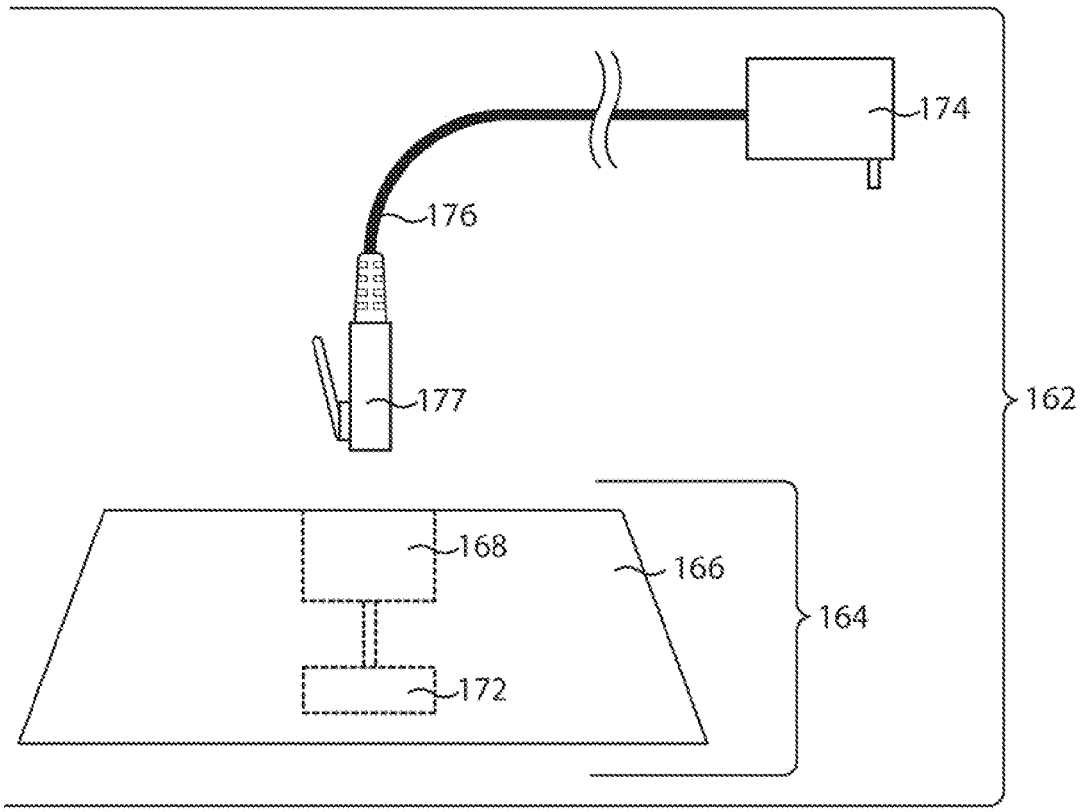
Figure 12:
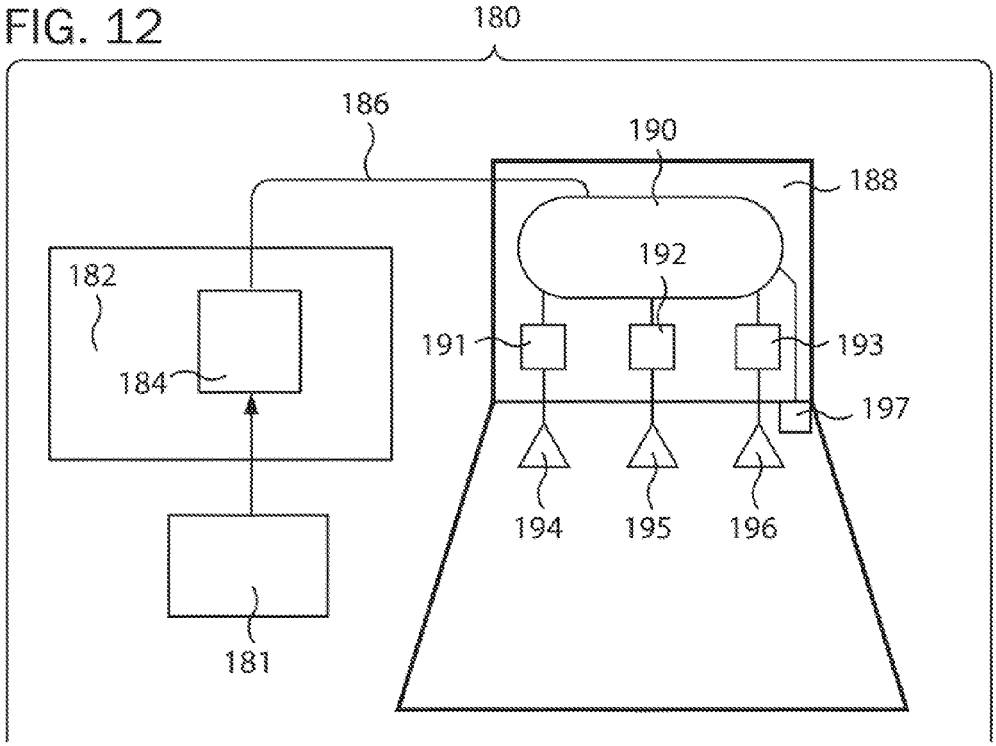
Figure 13:
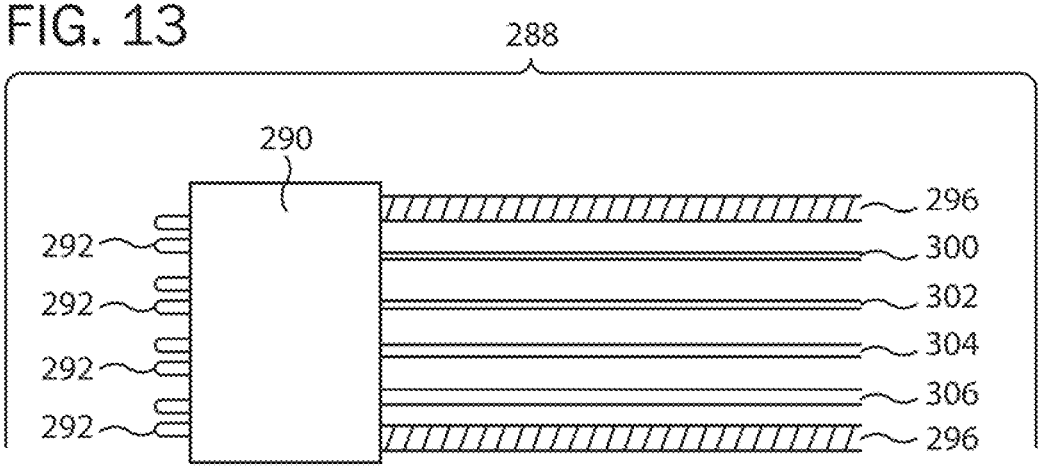
Figure 14:
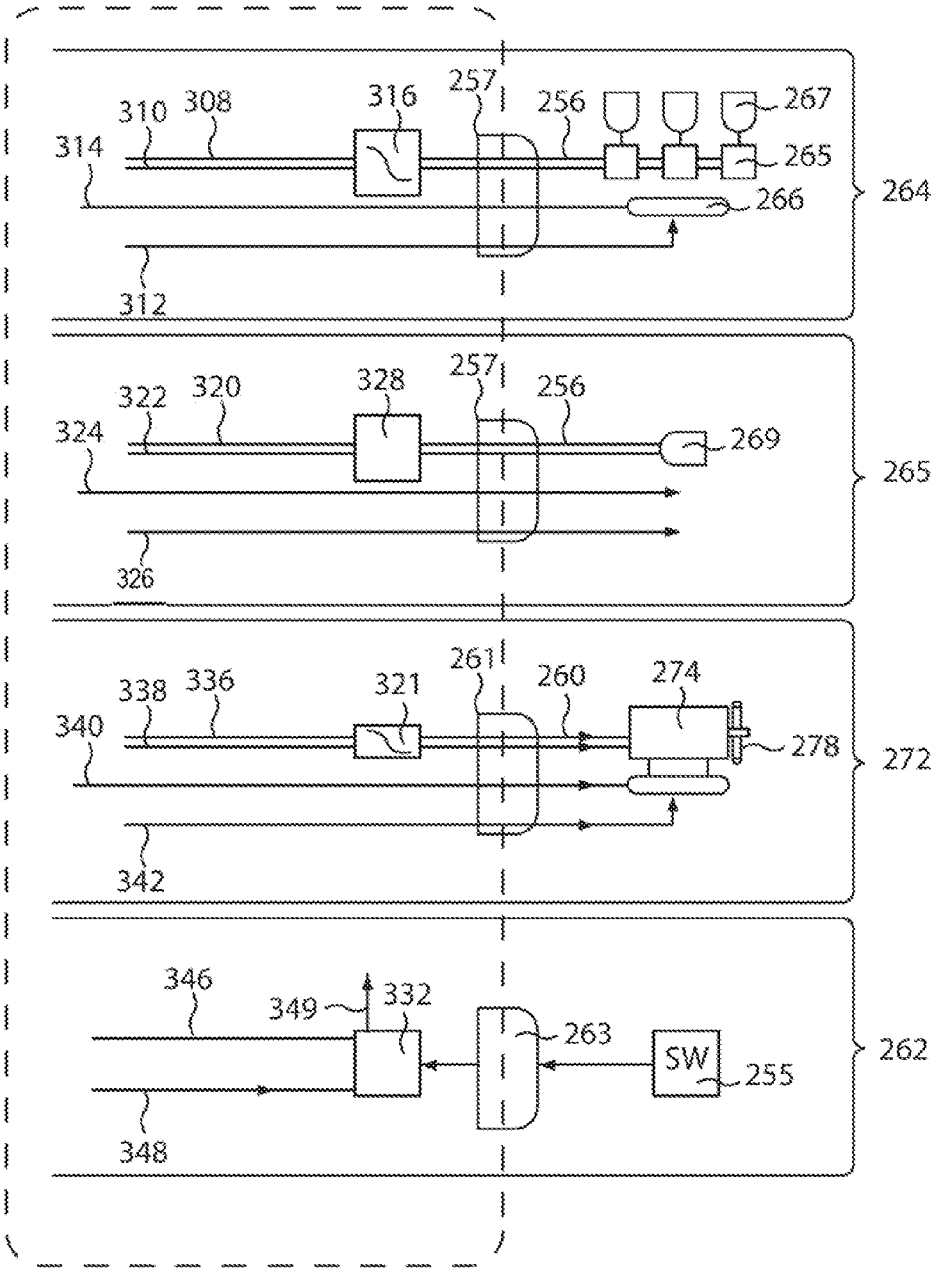
Figure 15:
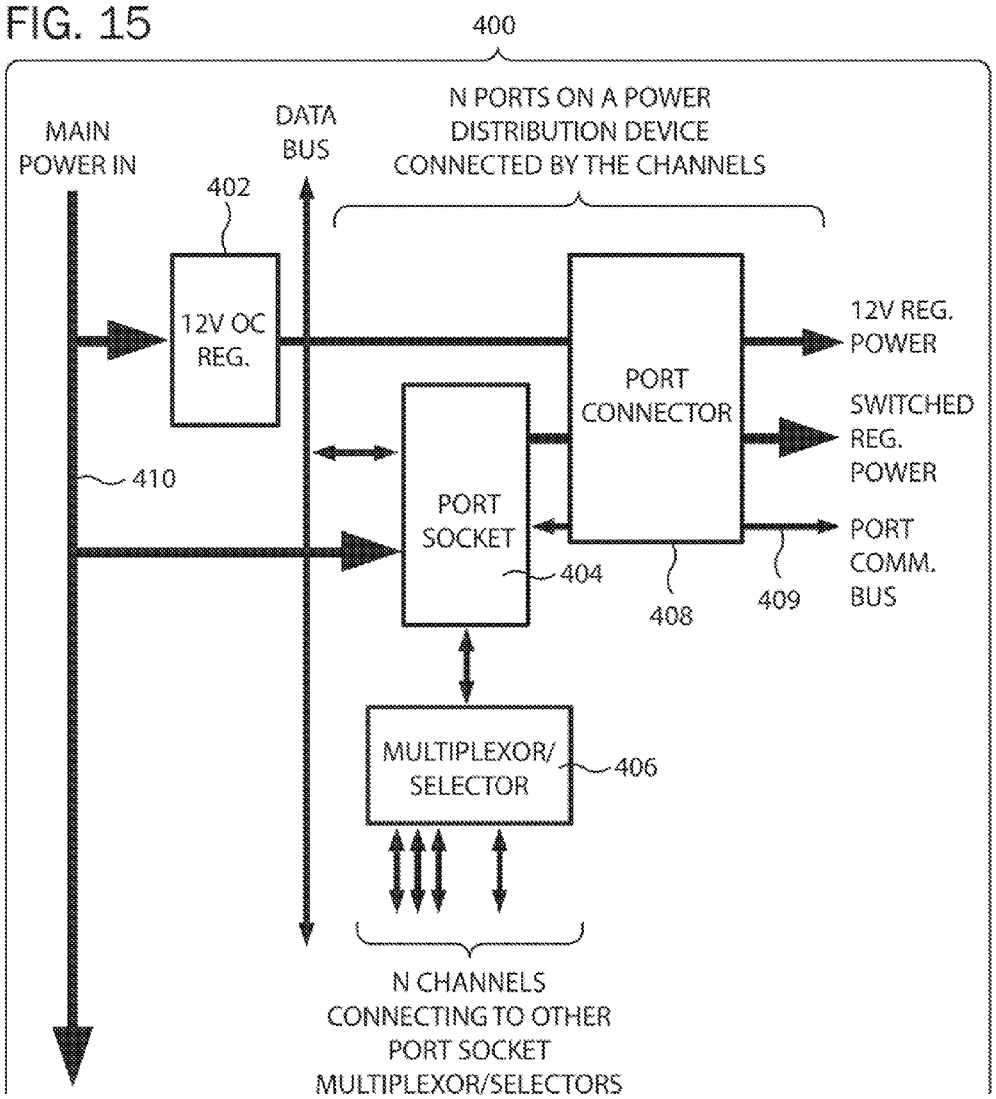
Figure 16:
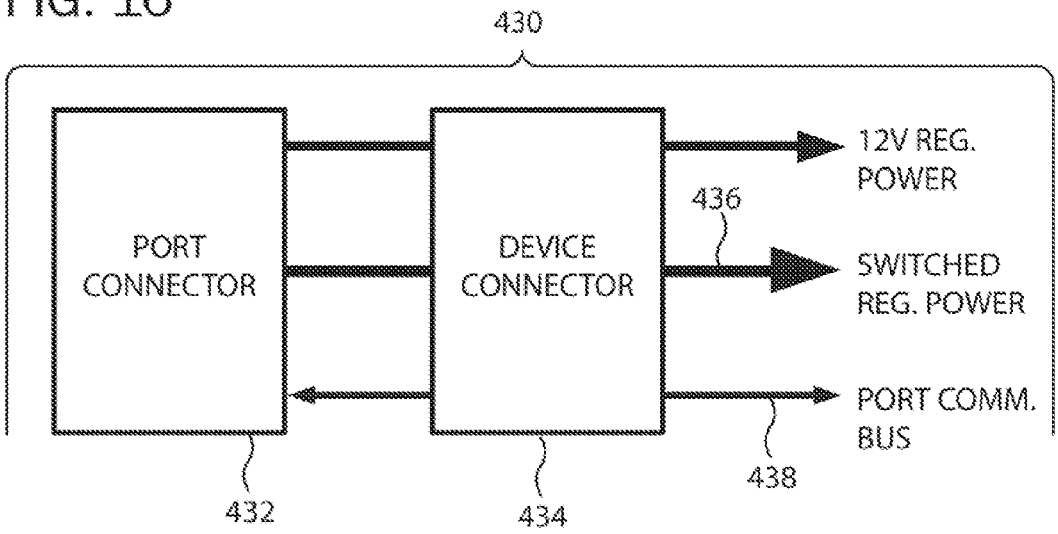
Figure 17:
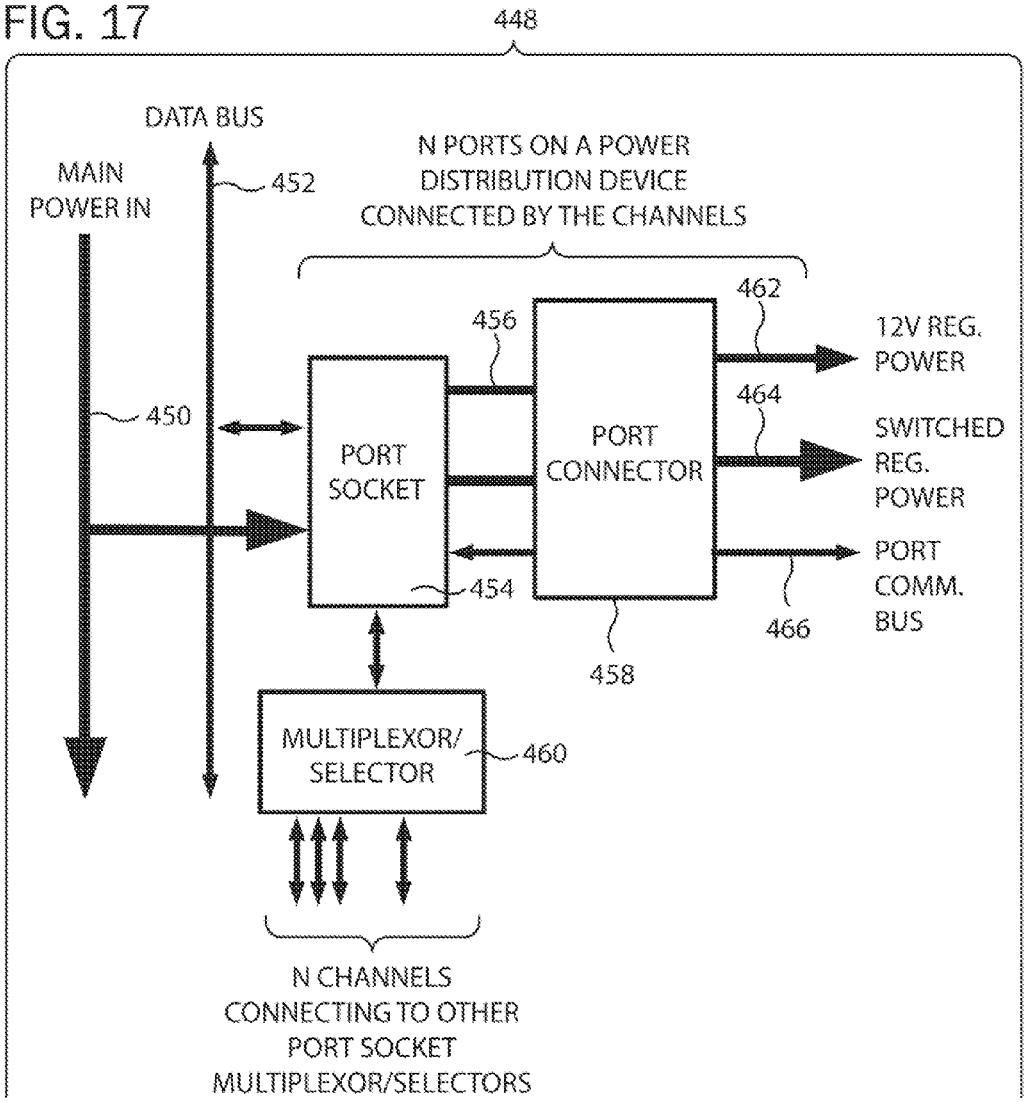
Figure 18:
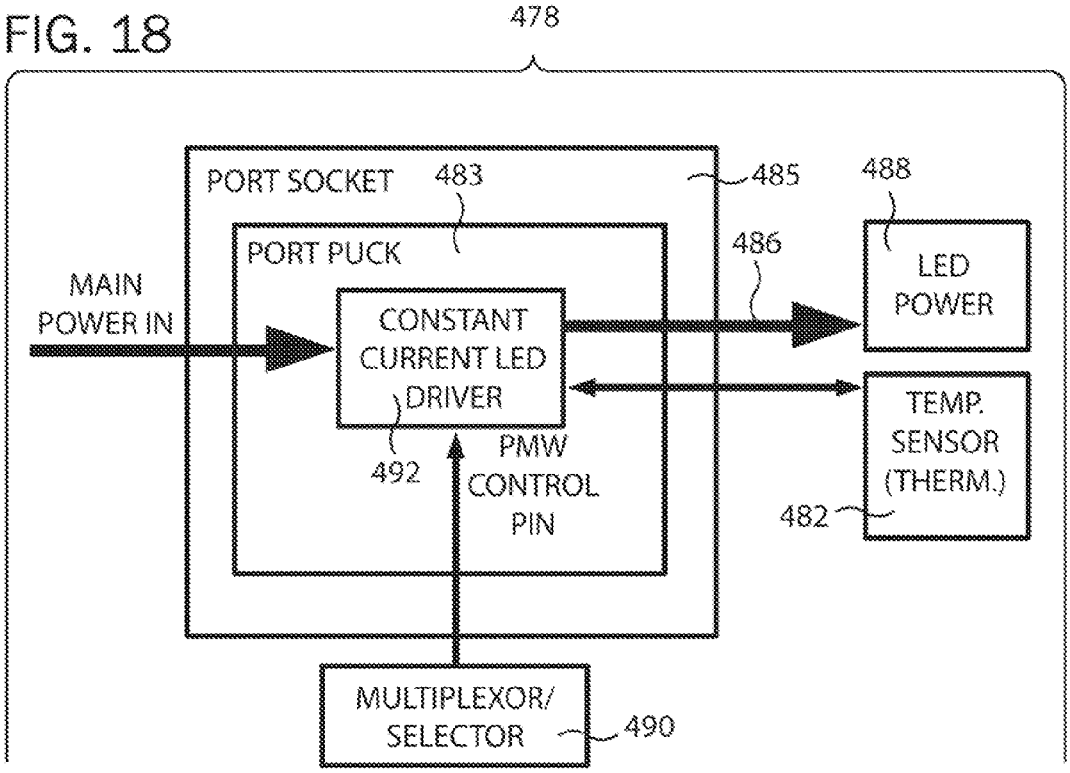
Figure 19:
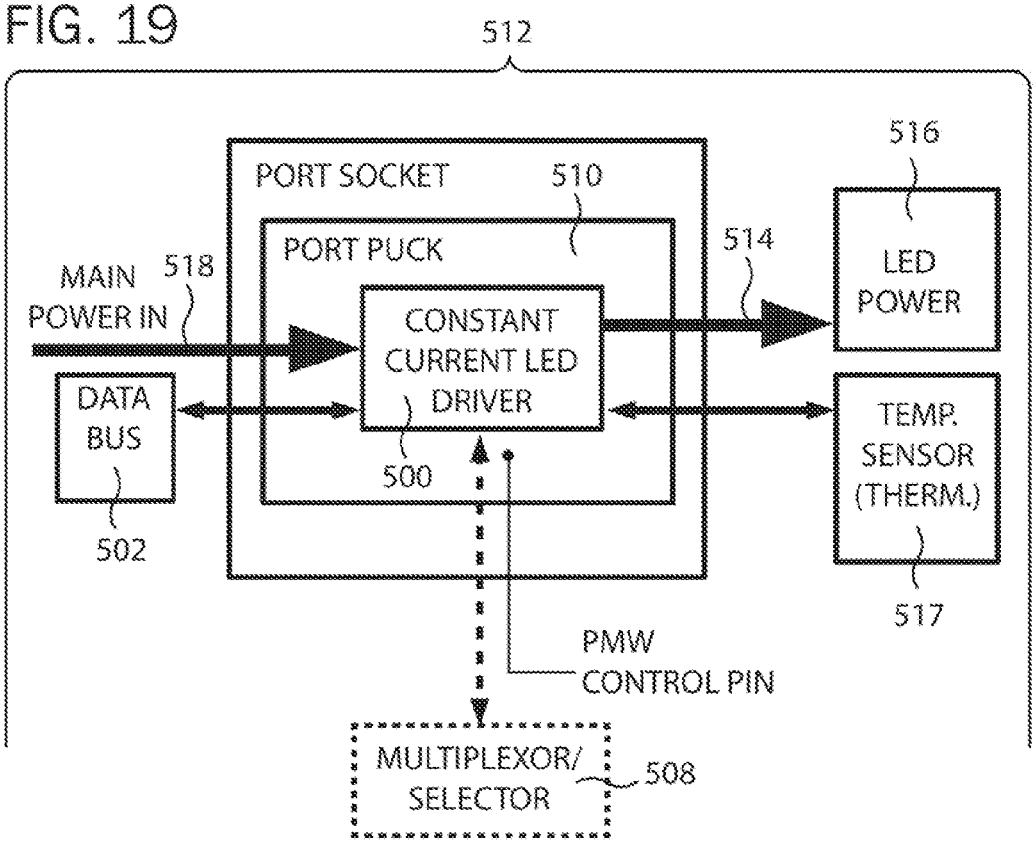
Figure 20:
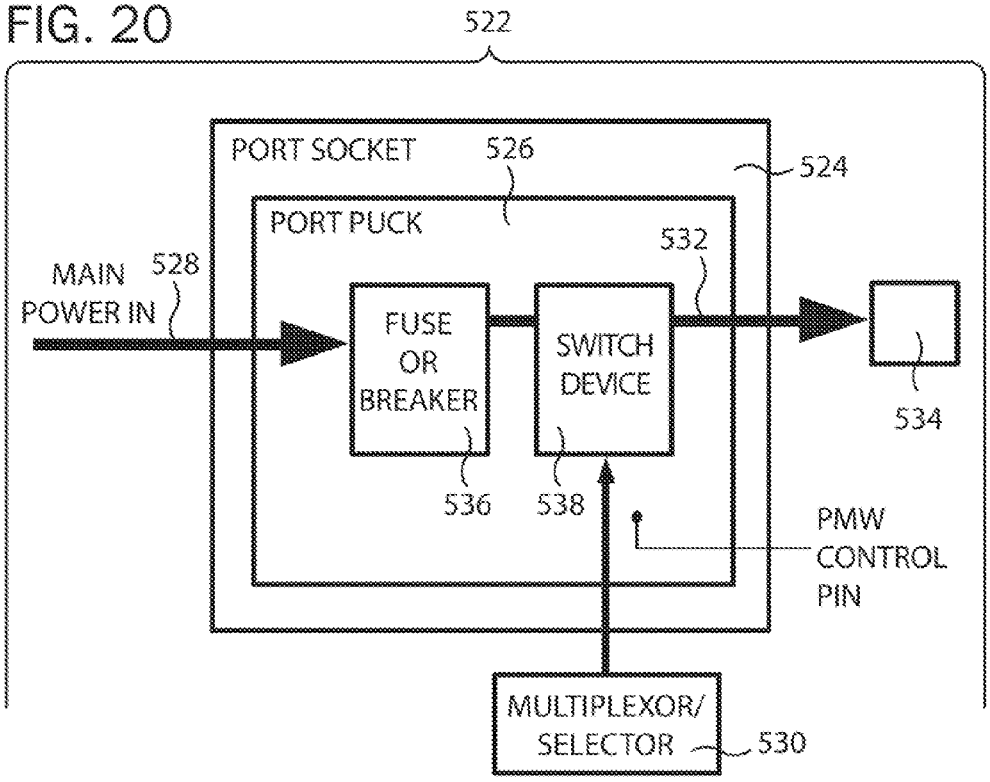
Figure 21:
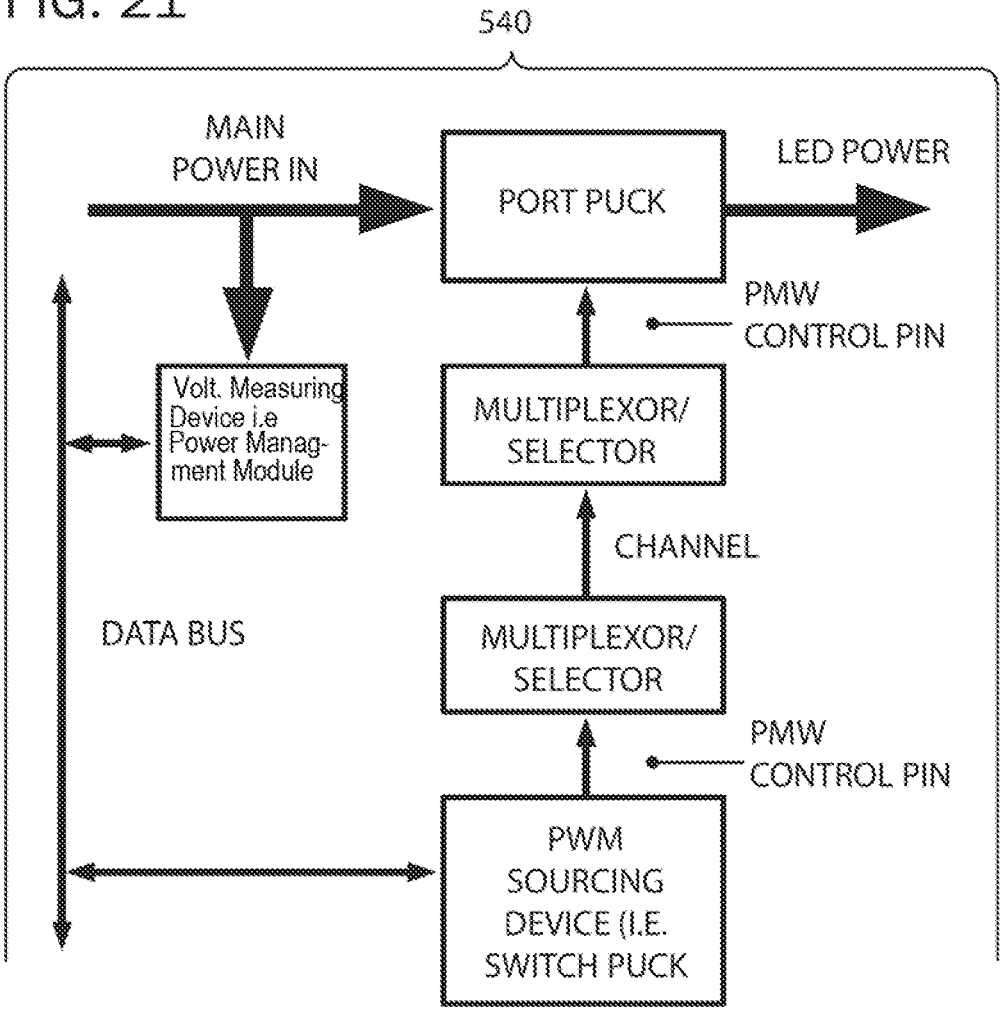
Figure 22:
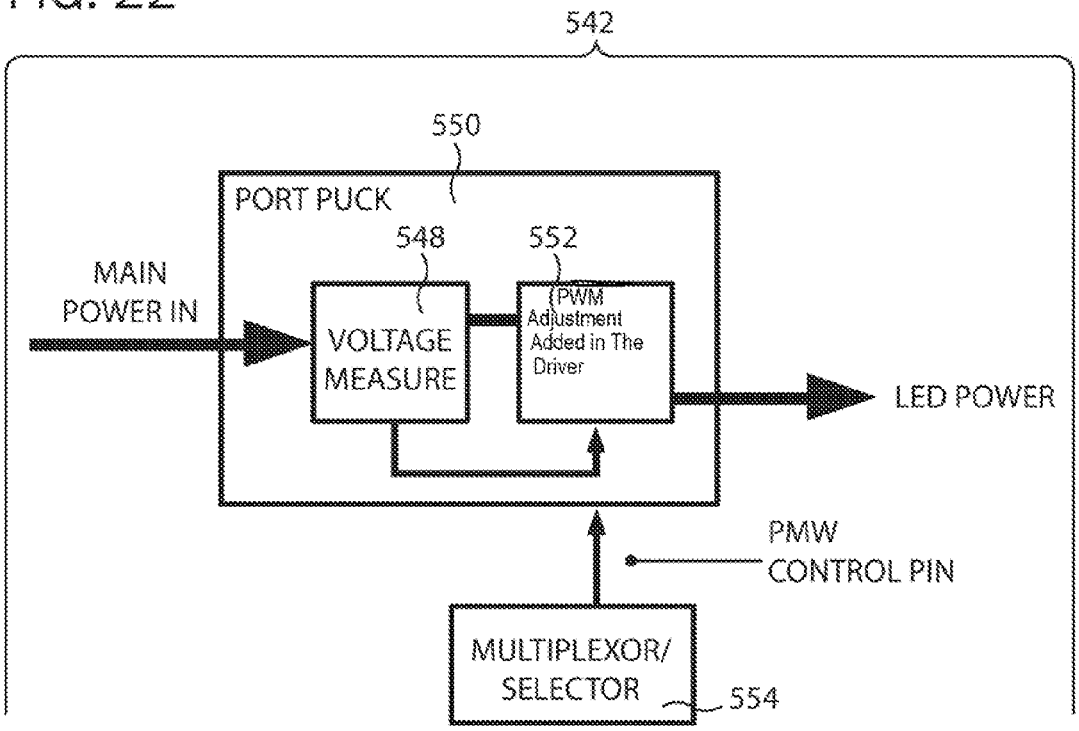
Figure 23:
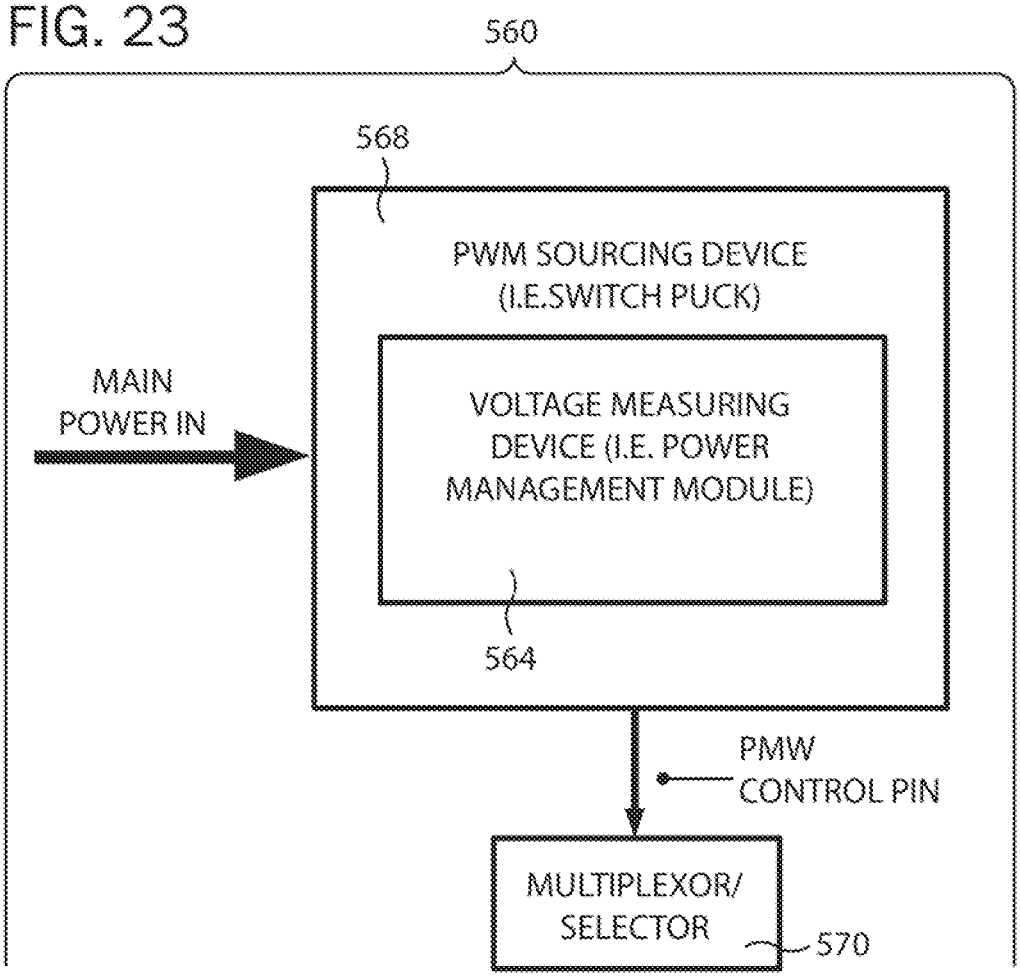
Figure 24:
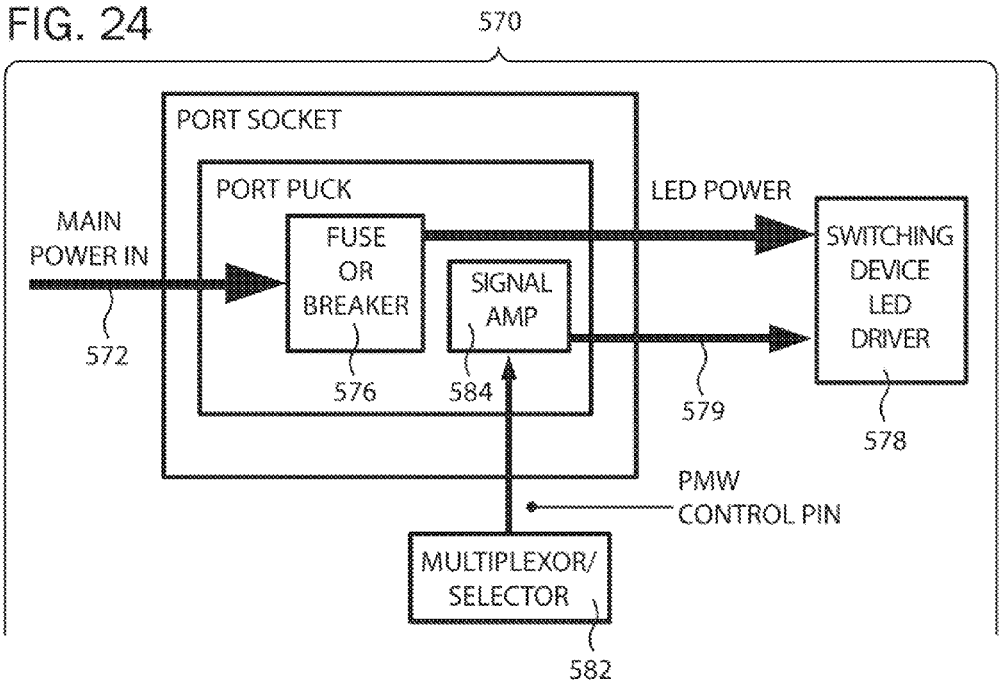

FIG. 9 is a schematic view of an alternate configuration system 230 showing a module 234 and a Power Distribution Unit (PDU) 238 having a backplane 240, where the lead terminals 232 to the field wires heading to the LED luminaries are located directly on the Load Module blocks 234 in addition to terminals 233, the Power Distribution Unit (PDU) backplane for convenience when using other than Category 5/6/7 type wire; and also shows the current including a voltage out adjuster 235 and master pulse width modulator mounted on the backplane, and the DC-DC modular current 239 mounted on the module block 234;

FIG. 10 is a schematic view of a prior art LED light fixture;

FIG. 11 is a schematic view of an LED light fixture of the present invention;

FIG. 12 is a schematic view of an alternate embodiment LED light fixture of the present invention;

FIG. 13 is a schematic, partly sectional view of a typical, prior Cat 5 cable useable with the present invention;

FIG. 14 is a schematic view of an exemplary power distribution module constructed according to the teachings of the present invention;

FIG. 15 is a schematic view showing the platform of the present invention;

FIG. 16 is a schematic view of port connectors to device connectors that comprise smart interface blocks of the present invention;

FIG. 17 is a schematic view of an alternate embodiment of a modular platform of the present invention;

FIG. 18 is a schematic view of a constant current LED driver of the present invention;

FIG. 19 is a schematic view of a constant current LED driver with a Communication Bus connection of the present invention;

FIG. 20 is a schematic view of a constant voltage LED driver of the present invention;

FIG. 21 is a schematic view of a self-adjusting light power output member capable of adjustments based on supply voltage;

FIG. 22 is a schematic view of a first alternate embodiment self-adjusting light power output member capable of adjustments based on supply voltage;

FIG. 23 is a schematic view of a second alternate embodiment self-adjusting light power output member capable of adjustments based on supply voltage; and FIG. 24 is a schematic view of a third alternate embodiment configuration that passes the Main Power Input to the LED Power outlet pins.

V. DETAILED DESCRIPTION

In the present invention, a lighting system comprises a bulb member that is powered by direct current (DC). The DC driven bulb is preferably an LED type bulb.

The driver is located remotely from the bulb, and preferably at a centralized or regionalized driver center. By centralized, one envisions a central bank of drivers that control all of the various lighting systems within a particular building or space. By regionalized, one is referring to a set of driver groups or gangs that would control a set of lights and the like. For example, there may be a regional driver gang that controls all of the lighting within the kitchen or first floor of the house, and a second regional gang that controls all of the lighting fixtures within one of the bedrooms.

A control mechanism is provided that controls the power delivered to both the drivers and the bulbs, and additionally performs communication functions so that communication can occur between the drivers, the bulbs, and/or the sensors placed remotely from the drivers, that can be placed adjacent to the bulbs.

In another embodiment of the present invention, an electrical system is provided for a residential or commercial structure. The system includes at least one of an AC or DC input. The AC input can comprise regular, utility delivered AC current into a load center, such as a circuit breaker array within the structure. The DC input can include a DC current generating source such as solar panels, exterior batteries, a DC generator, wind or any other source of DC current.

DC current is also fed through a lighting protection sub-panel into a circuit breaker or load center. The current emerging from the load center is driven to a charge controller. The charge controller essentially comprises a charger that has the capacity in an AC circuit to transform the AC current into DC current. The charge controller then outputs its current into a battery storage array that preferably comprises a 48 volt battery storage array. The 48 volt battery storage is preferable because a higher voltage battery enables current be conducted over longer distances with smaller wires.

The output from the battery storage is fed to DC breakers. DC breakers provide a form of short circuit protection, and are located in a position wherein they can perform their intended function. It should be noted that the DC current is being delivered from the battery storage and to all other points downstream in the system from the battery.

Current is then delivered to either to central or regionalized set of driver modules. The driver module can include two primary components. The first component is the "brain component" that includes software, firmware, circuitry or some combination thereof that treats the current and controls the current to perform a particular function. Downstream of the "brain controller" is the power controller that provides various control functions. Downstream of the controller/driver module are bulbs or sensors.

Additional module types provide a plurality of expansion capabilities including: communication bus expansion, input sensors, output relays, temperature control, security, appliance sensing & control, pump motor control, energy monitoring, and breaker control.

It is important to note that the wiring between the controller and the bulbs and/or sensors is preferably a category two or other appropriate DC wire such as category 5 (Cat 5) cable which is often used in Ethernet networks. Because of its particular nature, most building, codes allow Cat 5 cable to be installed by persons without any electrician license. Additionally, the output of a controller driver and the input of the bulbs can be affixed with Cat 5 plug receptacles, so the Cat 5 plug can be used. Cat 5 connectors are also known as RJ45 or Ethernet connectors.

Figure 1:
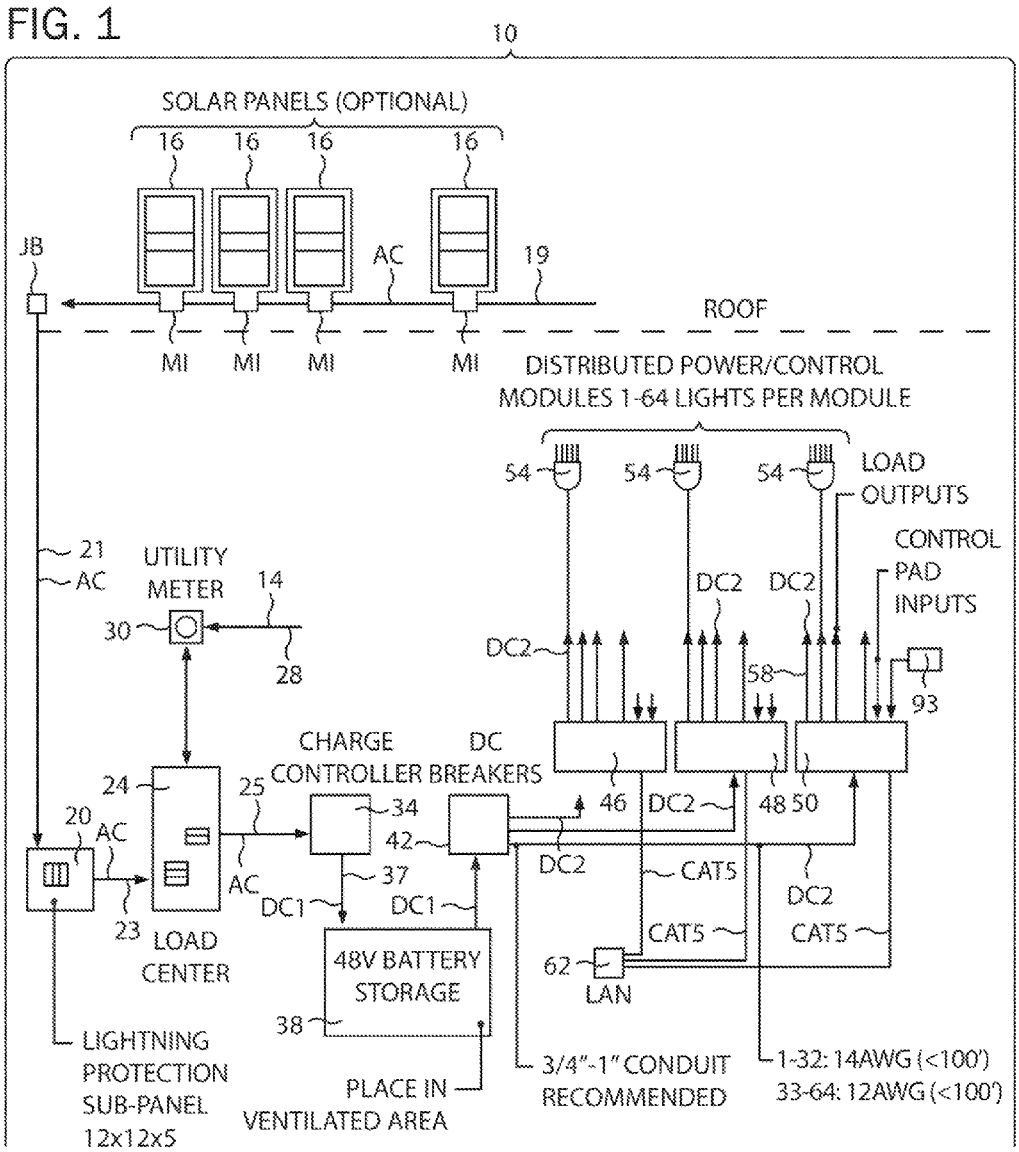
FIG. 1 is a schematic view showing the electrical lighting and control stem of the present invention.

Turning now to FIG. 1, a schematic view of the device 10 is shown. The device 10 includes both a DC input 12 system and an AC input 14 system. In the device 10 shown in the drawings, the DC input 12 comprises a plurality of solar panels 16. Of course, other DC inputs can be employed, such as batteries 38 or wind generated energy. The solar panels 16 feed their current into a lighting protection sub-panel 20. The lighting protection sub-panel 20 protects the remainder of the circuitry from lighting strikes and other current surges that can damage the circuitry. The lighting protection sub-panel 20 then directs the DC current into a load center 24 that preferably comprises a DC circuit breaker system or the like. Because of the current load from the solar panels, the conductors 19, 21, 23 employed are heavy duty wire conductors of the type that could be capable of conducting 120 V or 240 V AC current in the house.

Figure 2:
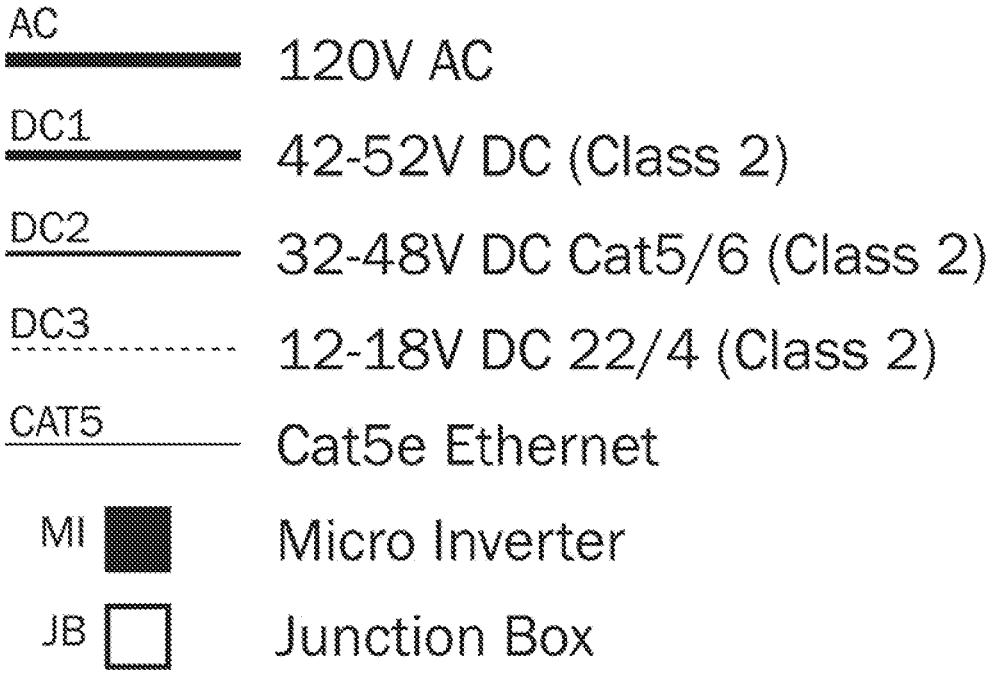
FIG. 2 is a legend chart that relates to FIG. 1 that shows the coding used to denote the VARIOUS CONNECTORS OF FIG. 1.
Figure 3A:
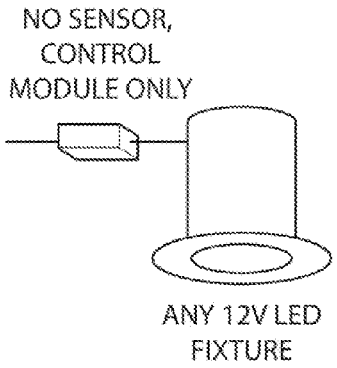
FIGS. 3-3D are schematic views of various fixture and sensor options that can be used in connection with the present invention.
Figure 3B:
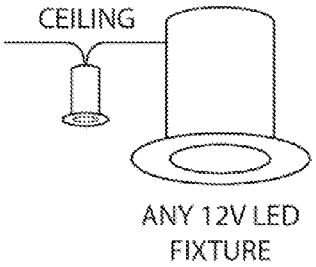
Figure 3C:
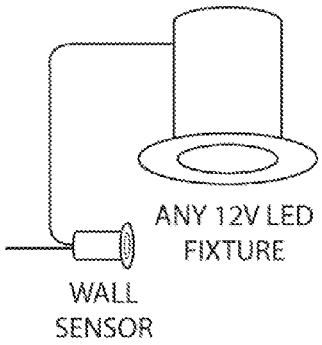
Figure 3D:
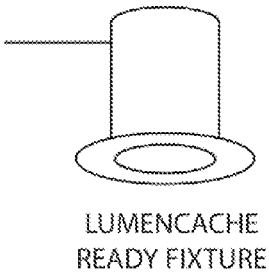
Figure 3:
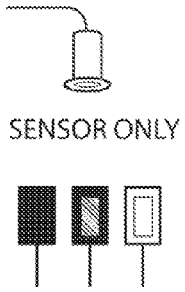

Turning now to FIG. 2, a legend is shown that illustrates the types of conductors that are employed in the device 10. It will be noted that the conductor type chosen for a particular connection is largely dependent upon the amount of current being conducted by the conductor.

The AC input system comprises a normal utility based input wire 26 that feeds electricity through is utility meter ter 30. The utility meter 30 is designed for net metering, since it is possible that the solar panels 16, could deliver an oversupply of electricity to the device 10, thereby enabling electricity to be delivered to and sold "back to the grid," to offset the amount of electricity "bought" from the grid. The AC input electricity is also directed into the load center 24 that comprises a circuit breaker panel or the like.

Current from the load center 24 is directed through conductor 25 into a charge controller 34. The charge controller 34 has two primary purposes. One purpose is surge protection. In doing this, the charge controller 34 helps to ensure that current that flows from the load center 24 is delivered to the batter array 38 (that is downstream of the charge controller 34)

through conductor 37 in a condition wherein there are no significant spikes or similar dangerous artifacts.

The second function of the charge controller 34 is to serve as a transformer for transforming AC current delivered by the utility into a DC current that is used to charge the battery 38. Current from the charge controller 34 is then directed to the battery array 38, that preferably comprises a 48 volt battery array 38. The battery array 38 is provided for storing electricity, and delivering DC based electricity to the lighting circuitry. The battery storage array 38 should be designed to deliver a smooth, perfect current to the downstream components in the system to ensure that there are no spikes or other irregularities or artifacts that might damage downstream components. An appropriate filter can be employed to aid in this smooth current delivery.

The battery 38 directs its output current into one, or an array of DC breakers 42. DC breakers 42 serve as a surge protection function. For example, the DC breakers 42 may have one input (similar to the circuit breaker), or more likely, a plurality of outputs with one output being directed to each of the electricity distribution module systems shown here as a first 46, second 48 and third 50 power distribution module for ultimately delivering electrical power to the electrical LED luminaries, or other devices, such as sensors that are connected to the system.

The module systems 46, 48, 50 are shown in the drawings as comprising "regional module systems" where a particular building or structure has a plurality of module systems 46-50. Each of the module systems 46-50 may govern a particular set of lights in a particular area on the structure. As discussed above, a central module system could be used to control all of the various lights within a house, rather than the regional module system 46-50 as being used in the system shown in FIG. 1.

Preferably, the module systems 46-50 work solely on DC current and are capable of delivering sufficient DC current to and from lights (FIG. 1) to enable the lights 54 to perform their intended function, while still enabling the user to use a data communications cable 58, such as a Cat 5 type cable, rather than heavy duty electrical cable.

The Cat 5 cable 58 includes not only a power distribution capability, but also an information communication capability. In this regard, it will be noted that the three module system 46, 48, 50 shown in the drawing (FIG. 1) are coupled together in communication with each other through a LAN 62.

Figure 4:
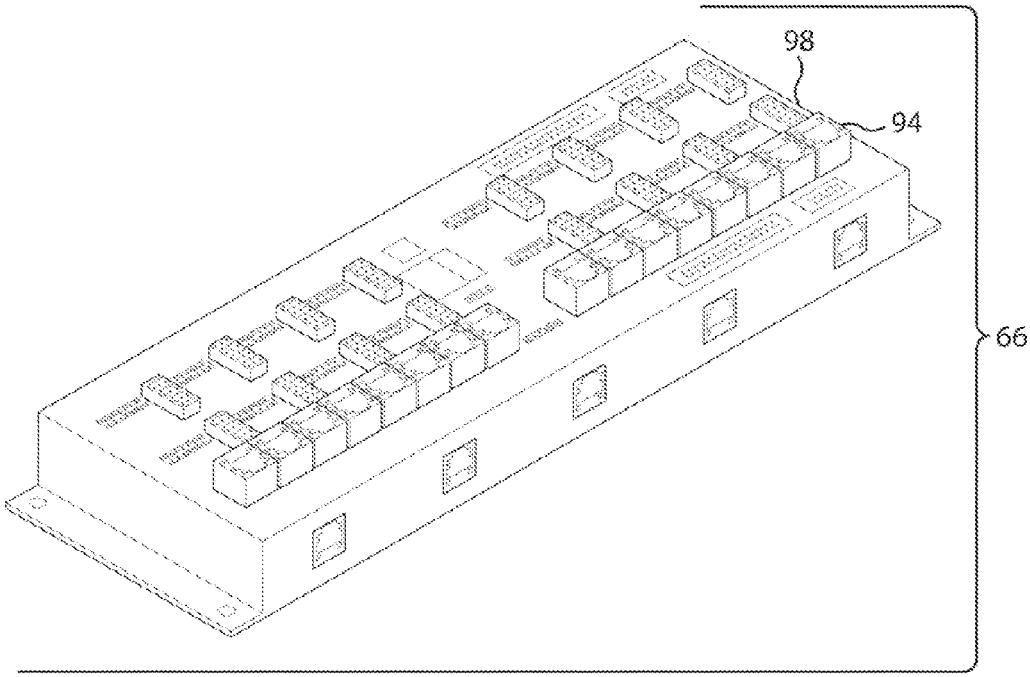
FIG. 4 is a schematic view of a driver switching panel of the present invention that includes replaceable modular dimming and switching cubes, Ethernet control and configuration switch, and a plurality of ports or plugs that permit cabling coupling to the switch box.
Figure 5:
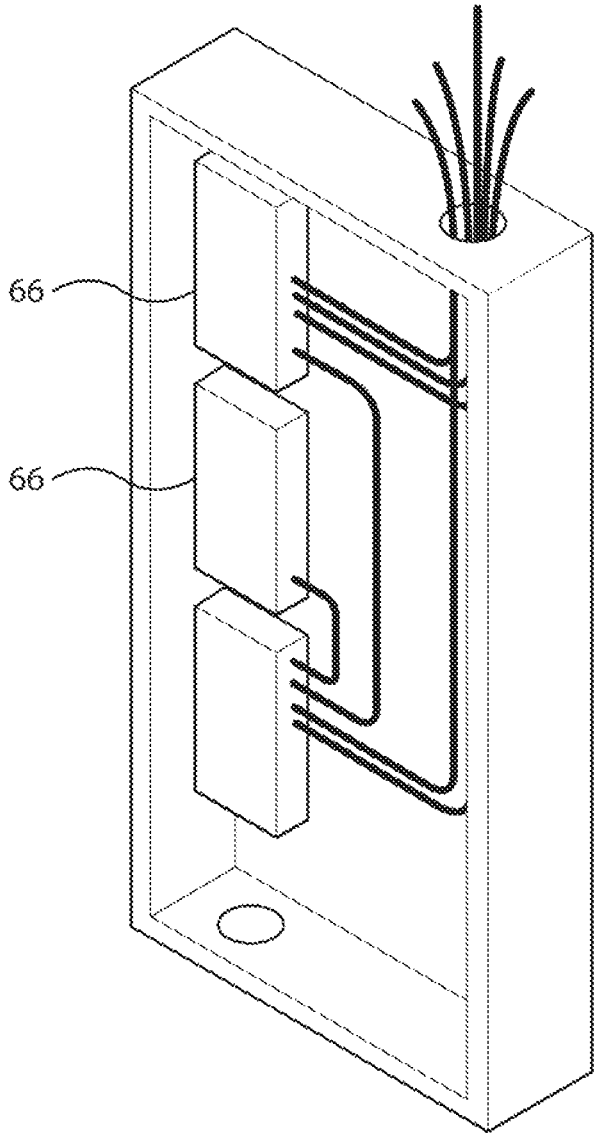
FIG. 5 is a schematic view of a lighting junction box that includes a pair of lighting power distribution modules 66 (LPD) and a power over Ethernet (POE) module.

Turning now to FIG. 6, a controller module 46 is shown in more detail. The controller module 46 includes several components. The highest level element is the controller 66 which is also shown in FIGS. 4 and 5. The controller 66 includes circuitry, and comprises a small computer that is capable of receiving sensor inputs. The controller 66 includes circuitry that is capable of both receiving sensory inputs and also providing command outputs. The controller 66 may be software driven or alternately, can be hard wired or firm wear driven.

The controller 66 includes a plurality of input ports including a first 70, second 72, third 74, fourth 76, and fifth 78 input port for receiving, and exchanging data from a variety of input sources 86. The controller 66 also includes a plurality of output ports. In the embodiment shown in FIG. 6 the output ports include a first output port 80 and a second output port 82. The output ports 80, 82 are provided primarily for providing power and communication from the controller 66 to the first 88 and second 90 power distribution modules.

The controller 66 communicates with a plurality of power distribution modules (e.g. 88, 90). The controller 66 is actually a processor that potentially could have a processing capability at a level similar to the processing capability that one might find in a currently produced PDA, tablet or Smart Phone. The controller 66 provides the control algorithms for operating the system. As such, the controller 66 is capable of being programmed, and of executing programs to provide an appropriate output. This output, among other things, is provided to the power distribution modules 88, 90.

Each power distribution module 88, 90 typically includes a series of processing chips (not shown) that are capable of performing functions such as conditioning the power that is fed to the driver cubes 94, such as pulse width modulation power conditioning. The power conditioner comprises a capacitor and an inductor. Another chip that can be employed in a power distribution module 88, 90 is a pulse width modulation chip. The pulse width modulation chip provides pulse width modulation coordination to a plurality of cubes 94 and/or light sources 54 so that pulse start times can be staggered. Preferably, the pulse width modulation chip can operate on somewhere between one and 24 channels to provide information to between one and twenty-for cubes 94 and or devices 54.

The third type of chip that one might find within the power distribution modules 88, 90 is a digital potentiometer used to adjust the current levels produced by the cubes 94. A further type of chip is an analog to digital input that is used to detect information such as temperature sensed by temperature sensors 93 that may be disposed adjacent to the light bulbs 54, or to sense other internal conditions within the cubes 94.

Electrical signals from the power distribution module 88, 90, along with electrical power, are then driven to the driver cubes 94. From the driver cubes 94, power is then supplied to the lights 54.

One controller 66 is capable of driving a plurality of power distribution modules 88, 90. This plurality of power distribution modules can include for example, 250 power distribution modules. Each power distribution module 88, 90 is typically capable of dealing with between one and 24 distribution cubes 94. These distribution cubes 94 may govern the action of one particular LED light, or one "gang" of LED lights. In this regard, it should be noted that an LED assembly may include a plurality (e.g. 15) of individual LED bulbs contained within a single enclosure to form a single "assembly" that is drawn as a single unit.

In the embodiment shown in FIG. 6, by first power distribution module 88 is shown as powering and communicating with four driver modules (cubes) including first 96, second 98, third 100 and fourth 102 driver modules. Second power distribution module 90 is shown as also powering and communicating with four driver modules (cubes) including first 106, second 108, third 110 and fourth 112 driver modules. Driver cubes 96-112 are provided for ensuring that the output of the power distribution module 88, 90 is appropriate for the particular device, light, etc., that is being driven by the cube. The drivers 88, 90 include electronics that take power from the battery and send power to the LED. They amplify or reduce the voltage from the batteries to the correct level for the particular LED, and also control the amount of current that can be delivered. The driver also may include electronics that couple to the user interface to enable the user to control the operation of the LED. The driver has a positive and a negative input from the battery DC power source and a positive and negative output that goes to the LED.

The LED driver chosen for a particular application should be mated well both to the power source and the LED that the driver 90, 94 is driving. For example, a five watt LED light would require a different type of output than a 30 watt light. Additionally, through a choice of circuitry, the driver cubes 96-112 can include things such as amplifiers or boosters to provide a relatively greater amount of output than is being fed into the input.

In this regard, further information about the operation of the LED circuits can be gleaned from a variety of reference sources, including, most conveniently, WIKIPEDIA.

As best shown in FIG. 6, it will be noted that the various driver cubes 94 are shown that control the different amounts of lights. For example, driver cubes 102, 110 and 112 each control a pair of lights 54*a*. In practice, each of the pair of lights can represent a gang of two or more lights, or alternately, can comprise several gangs of lights.

Driver cubes 96 and 100 are shown as controlling a single light 54*b*, or single light gang; driver cube 98 is shown as controlling three light gangs 54*c*: and driver module 106 is shown as controlling five light gangs 54*d*.

As stated above, the number of lights 54 or light gangs that are controlled by a particular driver cube is variable, depending upon the need and desires of the user. Generally, each driver cube, 94 is capable of controlling usually between one and 24 different lights, or light gangs. As used herein, a "light gang" is used to mean a plurality of individual bulbs that are wired together, so as to derive the power and their communication signal from a single, common source.

Additionally, a plurality of input devices 86 can be attached to the controller 66 to govern the action of the controller 66. These input devices 88 can include things such as switches, that enable one to turn lights 54 on and off and key pads that enable more sophisticated direction for the lights and controller. Further, more complicated input devices such as iPads, iPhones, smart phones, PDAs and computers can also theoretically be coupled to the controller 66 through the input ports 70-78. Through these computer and computer-like input devices 86, the user can program various functions into the controller 66 that can then be communicated through the power distribution module 88, 90 and driver cubes 96-112 to the lights 54, to enable the lights 54 to perform the functions desired by the user.

An additional type of input that is fed into the controller comprises a sensor input, such sensor 99. Sensor 99 input comprises input that is received from sensors that are often placed in areas of the building close to the light. These sensors 99 can include such things as motion sensors, light sensors, temperature sensors, proximity sensors, sound sensors and camera sensors.

In FIG. 6, a plurality of different input devices 86 are shown as coupled to the respective input ports 70-78 for coupling the input devices 86 to the controller 66. The particular input devices shown in FIG. 6 include a first input device 118 that can illustratively be a switch that enables the user to turn the lights on or off. The second input device 120 preferably comprises a highly complex programming input device, such as an IPad, PDA, smart phone or computer that enables the user to program a wide variety of different types of commands into the controller 66.

The third input device 122 is shown as preferably being a simple instruction command programming device such as a keypad through which the user can either program limited instructions into the device, or provide, a "lock/unlock" command to his controller, so that the controller can be locked to prevent the input of commands from unauthorized sources, and can also be "opened" to permit authorized persons to insert commands into the device.

The fourth input device 124 is shown as being a first sensor that can comprise a sensor such as a motion sensor, light sensor, temperature sensor, proximity sensor, sound sensor and/or camera sensor. The fifth input device 126 is also a sensor similar to sensor 124, but is preferably either a sensor that is providing information from a different location, or alternately, a sensor that is providing a different type of input, such as sensor 124 being a motion sensor to provide information about motion in an area adjacent to the sensor, whereas sensor 126 may be a camera sensor.

Turning now to FIG. 7, a schematic view of a power distribution module 200 is shown. Power distribution module 200 includes a nodule 202 and a power distribution unit 203 having a backplane 204. The backplane 204 has connectors to which the module 202 is connected. The power distribution module 200 comprises one of two power distribution module system architectures that help demonstrate the modularization of a lighting level control 219. Lighting level control 219 is located under the communication bus 214. Failsafe control circuits are also part of the component that serves as a lighting level control 219. LED power management circuits including load out limit adjuster 207, voltage out adjuster circuit 205, pulse switch modulation (PWM) chopper 210 are also provided for a part of the load module. These components are contained within the load module, also with a voltage out sensor 221 and the communication bus 214. The load module 202 comprises a smart cube module design where circuit management and pulse switch modulation dimming are accomplished within the load module 202.

A second system architecture 218 is shown in FIG. 8. FIG. 8 has few components in the load module 220, and more components placed on the backplane 224, as compared to the power distribution unit 203 that is shown in FIG. 7.

Power distribution unit 223 includes a module 220 in the backplane 224. In this architecture, the power width modulation output of the load module 220 is controlled directly from the power distribution unit backplane circuits 218, and the voltage out (Vout) circuit 229. Only current or voltage control circuits 228 are contained in the load module 220, with a current or voltage adjustment signals being sent from the backplane 224 processor for each attached load module 220. Additionally, FIG. 8 shows the presence of output terminals 216 to which connectors can be connected for connecting the output of the power distribution unit 203 to LED luminaries. Further, an output terminal 217 is shown.

It will also be noted that output terminals 209 and input terminals 211 are also provided on the device 203 shown in FIG. 7

FIG. 9 shows a schematic view of an alternate configuration system 230 that includes a module 234 and a power distribution unit 238. The power distribution unit 238 includes backplane 240 where the lead terminals 232 to the field wires heading to the LED are located directly on the load modulo blocks 234. Additionally, output terminals 233 are loaded on the backplane 240, as is the input terminal 241.

Using the two different output terminals adds additional convenience to the unit, to provide another jack type that will be useable with wires and jacks other than the wires and jacks typically used with Cat 5, Cat 6 or Cat 7 type wires.

FIG. 9 also shows a voltage out adaptor 235 and a master pulse width modulation circuit 236, along with input terminal 241. Input terminal 241 and master power with modulation circuit 236 are also mounted on the backplane 240. The circuit further includes a DC-DC module 239 that is mounted on the module block 234.

Although five sensors are shown as being coupled to the controller, a much larger number of input devices can be provided, or for that matter, a small number of input devices. Additionally, a particular "mix" of input devices shown on FIG. 6 is merely illustrative and is subject to a wide degree of variation and change depending upon the particular desires and goals of the user of the system.

In a broad perspective, the sensor control system of the present invention enables the users to achieve three important functionalities. A first functionality relates to automatic configuration for lighting control systems that may include a method for detecting natural and artificial lighting for light harvesting applications. Through this functionality, an array of light level sensors are used, along with artificial light controls that are programmed to detect adjacent areas affected by artificial light and natural light sources. These sensors help to create a virtual map of lighting conditions, as affected by the light sources. The light map so created in this regard, is used to control automatic light harvesting to help make lighting more efficient by reducing the unnecessary lighting when ambient light is available.

For example, remote sensor 99 that is positioned at or near the LED light can represent one, or a plurality of sensors that can communicate through the CAT 5 or other cable that pass the lights 54 within the controller. As such, the connectors, such as Cat 5 connector cable 123 between sensor 99 and driver 102; and the shared Cat 5 cable 125 that sends power to light 54, and conducts communication signals from sensor 129 to driver 100, along with connectors 131, 133 (that may comprise plug and socket connectors or Cat 5 cables) place the sensors 99, 129 in communication with the power distribution module 88 and controller 66, so that information communicated by the sensors 99, 129 to the controller 66, can be acted on by the controller 66 to control the operation of the lights 54.

Additionally, LED lights 54 can be independently flashed at high frequency conditions controlled by the system. The light levels are measured during the on and off cycle to detect light levels in the vicinity of lights and sensor controller interfaces. Controllers, such as controller 66 can be programmed to learn which lights are in the vicinity of any particular light sensor, and to understand the relationship between the various lights and the various sensor devices. These relationships can then be used to enable the user to configure light operation by means of a program and algorithm, that configures the lights 54 to operate based on various inputs from the system including other sensors and environmental, data. The actual sense evaluator and command programming can be performed by the controller 66 or on input device, such as a smart phone or PC 120 coupled to the controller 66.

The second functionality that can be performed by the present invention relates to enabling the system to learn human occupancy detection for predictive lighting controls and energy management. For example, most motion sensors can sense the presence of a human, and turn lights on or off, depending upon whether the human presence is detected or not detected. In such a case, sensors 99 and 129 that are placed in occupied areas of the structure remote from the controller 66 could be motion detection sensors. The functionality is currently achievable by motion detector sensors available from a variety of sources, such as General Electric.

However, the present invention takes the functionality of this common motion sensor at least one step further by enabling the lighting system to learn from human interactions with the sensors to make predictions based on what the system has learned to determine how the humans who inhabit the particular structure will act in the future. An example of learning behavior is to start with a scenario wherein all of the lights in an upstairs hallway turned off. Through experience, the system may learn that the detection of a human presence within the hallway usually suggests that the particular human will travel from the hallway to one of the rooms upstairs. As such, the detection by the sensor of motion by the human in the hallway will first turn on the lights in the hallway, and then transmit a signal to the "brains" of the system, such as controller 66. Controller 66 through appropriate programming based on past experiences may then cause the system to then turn on lights in one or several of the rooms connected to the hallway, so that when the user enters a particular room, the light is already turned on for him.

Traveling further in this hypothetical example, a time delay may exist between the light being turned on, and the detection of the presence of the human in one of the rooms. For example, if the system detects that the human is present in room A, the light may remain on in room A. However, if the system turns on lights in rooms A and B but motion sensors placed in rooms A and B detected only motion, and hence a human presence in Room A, the controller 66 may send a signal to the lights in room B to shut off, while sending a signal to the lights in room A to remain lit. Preferably, timing circuits are employed to as to provide a suitable period of time to prevent the person whose movement is being detected to decide which room to occupy next, and to travel to that room. Similarly, the fact that the user goes into the bathroom may cause the system to turn the lights off in each of the bedrooms, since the bathroom tends to be a terminal destination for the user.

In this functionality, a network of sensors applies a neural network algorithm to predict the pattern, of occupancy and movement of occupants to control lighting ahead of a potential path of the human. Training and learning is achieved by the system through the user feedback via control pads, Smart Phone interfacing, wireless touch pad interfaces, computer interfaces, audible detectors, camera detectors, motion sensors, and blue tooth device detection to train the system to learn, and to predict the occupants' behaviors, their likes and dislikes.

For example, motion detectors may detect a particular movement of a particular occupant over time to predict where the occupant will go. However, the user may also be able to input various preferences. For example, if a structure is occupied by children who are afraid of the dark, the user may choose to program the system so that the detection of particular user (or any user) in the hallway causes all of the lights in all of the rooms to be illuminated. In contrast, the family "late owl" who goes to bed after everyone else has long retired, may perform a manual input into the system so that the detection of his presence within the hall only turns on lights within his particular bedroom, so that persons sleeping in other bedrooms are not awakened to lights being turned on by the present invention.

The user, through an interface, can program a "do not disturb" function. For example, if the user goes to bed, he may use an interface, such as a Smartphone, Bluetooth device, iPad, switch, etc., to tell the system to place itself in a "do not disturb" mode in his particular room. As such, the detection of the presence of other users will not cause light in user's particular room to turn on, due to the do not disturb indicator. Additionally, the user may decide to set the do not disturb function so that the existence of motion detected by the detector does not turn the lights on in the house. This sort of setting may be employed by a user when the user goes to bed, to prevent the movement of the family dog or cat from turning on lights and thereby awakening the user.

A "hold" feature causes the system to maintain the current selected lighting levels in the areas controlled by that control pad or virtual interface. The hold setting may maintain light output or overall ambient level at a desired level. A temporary hold mode maintains the hold setting for a pre-determined period, or an adjustable period based on various sensor conditions.

Additionally, the system can be designed to distinguish between movement made by humans and movements made by pets and other animals, often based on size or movement habits and the like. The system can learn to determine the difference between humans for whom it will turn lights on and off and pets and animals, for which the system will not initiate any turning on or off of any lights.

The third functionality achievable with the present invention is to provide an uninterruptible modular DC power distribution monitoring control system for low powered DC lighting electronic devices without AC power. As shown in FIG. 1, the power that feeds the module devices 46-50 and ultimately the devices 54 is provided by a battery 38.

The battery 38 typically will have a storage capacity sufficient to power the system for a given period of time, without the input of additional electricity charging into the battery. Since the battery 38 is locally based, and not based upon the input of electricity, such as a solar panel 16 that depends on light or an AC power source system that depends on power from the grid, power from the battery 38 can be used regardless of whether the external DC power source is operating and/or regardless of whether the AC lower grid is functional.

The uninterruptible modular DC power distribution system can be programmed depending upon the size of the battery 38 used, to run a large number of devices and lights 54 within the house, or to work at a "conserve mode" so that the power will last longer by cutting down the devices operated to only those devices that are critical.

In this regard, power and control for lighting and home electronics can use the standard interface module device that can be imbedded in a multitude of OEM devices, including electronics and LED lighting. The device 10 can also permit this system to allow a mixture of multiple configurations or DC light fixtures. In this functionality, the DC/AC module converts DC power to replace the traditional 120 volts AC or 240 volts AC-DC power adapter. Preferably, the modules are designed to be capable of detecting the power demands of the power device and report energy requirements. Load shedding can also be controlled through load interfaces.

As stated above, another advantage of the use of this DC power distribution is that it enables a large number of lighting and electronic devices within a structure such as a home to be operated by a DC based, low power based system using Ethernet type cabling, rather than the standard power ports used presently.

A further feature of the present invention is that the system can incorporate demand management functionality into the program. Demand management functionality helps to balance the electrical load, to help reduce system and component inefficiencies. One example of demand management adjustments that can be performed by the device 10 is that the lights 54 can be turned off when either the sensor (e.g. 99) detects that no one is present in a particular room, or else, the sensor 99 might detect that there exists external light to provide enough ambient light within a particular space so that the additional light provided by the LEDs 54 is not needed.

Another feature that can be programmed into the invention is a battery conservation feature that adjusts operational parameters to maximize battery 36 life. For example, a sensor can be employed to sense the level of battery capacity. When the battery capacity-level decreases and is not in a position to be replenished quickly, the system can be programmed to effect a "brown out" within the structure to reduce the lighting or shut off certain lighting, so that the battery 38 will be able to provide power for a longer period of time, or hopefully, provide power long enough for the charge level of the battery to be increased, so that the lights are never turned off completely. Performing this battery conservation programming can help to reduce energy costs by allowing the batteries to rely on "free energy" such as that provided by solar panel 16 to recharge the battery, rather than relying on purchased power from utility owned AC electrical grids.

This programming can be performed not only to handle situations where the power grid is incapable of supplying electrical power to the system, but also in situations where one wishes to avoid using power from the power grid. For example, if one wishes to reduce power consumption by relying primarily on the solar powers, one could program the battery conservation system/components to reduce the power being drawn from the battery at those times when the solar power is not able to regenerate the battery, so that the battery can power the lights for a sufficient period of time, to enable the solar power sources to begin generating electricity to provide power to the battery, to thereby obviate the need for drawing power from the electrical grid.

Another feature of the present invention is that sensors and programming can be provided that can monitor the health of various components in the system. Among those components whose health one may wish to monitor include the lighting devices the sensors, the driver cubes, the ver distribution module and the controller.

To accomplish this, the system 10 can monitor parameters that are often indicative of component failure. Such parameters include excessive temperature, failure of a system such as a sensor, and a failure of a component to communicate with the system.

Failsafe modes in the power distribution units 66 and driver modules 94 allow connected control keypads and/or computing devices to directly control the driver modules 94 attached to the power distribution unit in the event of communications failure between the main processor 62 and the power distribution module. Additionally, some of the input items can be non-contact items. For example, a non-contact proximity switch can be employed as a user input device to turn on light switches or otherwise control various functions served by the controller and the lighting devices. Ideally, the sensors (e.g. 99, 129) should be incorporated into the light fixtures. Fixtures of this type described above can be provided by a plurality of vendors. Preferably, the device of the present invention incorporates a standard interface design so that there will be more selections and compatibility among various components and sensors.

The keypad interfaces use a combination of selection buttons and finger movement to make selections and adjustments to the lighting levels in many intuitive ways. For example, the interface can employ a touchscreen type display that enables one to turn lights on and off by quickly passing one's finger up or down the control interface respectively. Two fingers swiping together on the interface will dim lights, expanding fingers raise the level of light being emitted by the light. Tapping the top half of the interface turns the lights on. Tapping the bottom half turns them off. Holding and pressing on the top of the interface will raise the lighting level; and holding the bottom half of the interface will dim the lights. Sweeping left or right on the touchpad will increment or decrement which lighting zone is being controlled.

As discussed above, the cube should include a Cat 5 cable jack (outlet), as Cat 5 cable is currently believed to be one of the best vehicles for transmitting power from the cubes to the various light fixtures. However, the cube should also include alternative jacks, so that other types of jacks can be received that are coupled to other types of wires for conducting current from the cubes to lighting systems and components that are better served by a wire type or jack type other than a Cat 5 wire and a Cat 5 jack.

In an alternate embodiment, a DC power source such as solar, generator, external battery or the like can deliver power directly into the charge controller, for feeding the current directly into the battery, without going through the load center. Such a system would be especially useful in a system wherein AC inputs were not readily available, such as a portable system that one might find in a vehicle, or in a wilderness location isolated from the power grid.

The modular Load Modules or Driver modules can also be replaced with other expansion modules to extend the data communications buses, add sensor input modules, or add relay or other output modules for purposes including space temperature control, security, and/or other the monitoring and control of other electronics and appliances. The control of these devices is accomplished through the top-level control processors or through local processing inside the expansion nodules.

Attached hereto as Appendix A, is a copy of the LUMEN CACHE-brand Design and Implementation Guide that was written by the Applicant. This Design and Implementation Guide helps to give further examples of the components, and the configuration of devices and systems according to the present invention. This Design and Implementation Guide is fully incorporated herein, and is made a part of this patent application.

Attached hereto as Exhibit B is an exemplary description of a most preferred Power Distribution Module showing its shape and dimensions. Exhibits A and B are fully incorporated into this patent application and made a part of this patent application.

To understand the driver 94, it is important to understand that the driver acts primarily as a filter that takes in unconditioned electricity and puts out "conditioned electricity" to the LED 54. The driver 94 does not have a source of electricity, nor is it a source of a switch. However, a switch can be added to the driver 94 to control its operation.

A prior art light fixture 150 is shown in FIG. 10 as including a housing 152 having an AC power inlet, here shown as a plug 154. The AC power inlet 154 can also be a wire, but in any event, serves as a point through which AC power is delivered to the light fixture 150. The prior art light fixture 150 also includes an LED bulb 156. As discussed above, the LED bulb 156 can be a single bulb, or it can be a gang of bulbs depending upon the user's preference.

A driver 160 is provided for ensuring that the current that is delivered to the LED is first transformed from AC current to DC current, and secondly, that the current is provided and conditioned appropriately for reception and use by the LED. As discussed above, this prior art fixture works well, but has a drawback as it requires that the driver and LED 160, 156 be part of the same unit which increases the costs of the light fixture 150, along with making it more expensive to replace bulbs and limits the flexibility of design.

Turning now to FIG. 11, a light fixture 164 of the present invention is shown. The light fixture 164 of the present invention is generally similar to the light fixture shown in FIG. 10, as it includes a housing 166 and an LED 172 that may comprise a gang, of LEDs 172, or a single LED bulb. A first significant difference relates to the input source for the electricity. In prior art fixture 150, AC power is delivered to the driver 160 within the fixture 150. In light fixture 164, DC current is delivered to the fixture 164 through a Cat 5 cable from a remotely located driver 174 that is not a part of fixture 164.

Although plugs for cables other than a Cat 5 cable can be used, an RJ45 plug 168 is one vehicle for providing the necessary current to the LED 172. For that reason, an RJ45 plug receptacle 168 is formed to be part of the fixture. An RJ45 plug receptacle is the typical plug receptacle used with Cat 5 cable. Wires extend between the RJ45 plug fixture 168 and the LED light 172 to conduct current from the RJ45 plug receptacle 168 to the LED 172. A Cat 5 wire 176, having, an end RJ45 177 plug is plugged into the RJ45 receptacle 168 on or attached to the fixture 164 itself, to provide the DC electric current that is conducted from the RJ45 plug receptacle 168 to the LED. RJ45 plugs are available from a variety of sources, including Belkin products of Los Angeles, Calif.

In the device 162 of FIG. 11, the driver 174 is not part of the light fixture 164. Rather, as discussed above, the modular driver 174 is connected at the regional control unit (e.g. 66), or perhaps, master control unit for controlling a plurality, or possibly all of the LED fixtures within the structure. Electricity is conducted through the driver 174 located at the remote regional unit, where the driver 174 conditions the DC electricity for the LED 156. The conditioned electricity is then conducted through the Cat 5 cable 176 to the plug receptacle 168 of the LED fixture 164, where the electricity is employed to light the LED 172.

By creating a fixture 164 as described above, one saves the time, hassle, headache and expense of replacing the driver in each LED fixture 164. Rather, the fixture 164 can be made without a driver 174, since a less expensive, more easily installed or easily replaceable driver 174 can be installed at the regional control unit.

Additionally, by conducting the conditioned DC current from the driver 174 positioned at the remote control module to the light fixture 164, the cabling 176 carries less electricity. As the electricity being conveyed is low amperage DC electricity, the electricity that is conveyed is considered to be "unregulated Electricity". The electricity is considered to be "unregulated" since the normal building code provision that require certain gauges of wire, and that require the cable to be installed by a licensed electrician do not apply to the low power DC current conveyed to the fixture by cable 176. By carrying only an unregulated amount of electricity, the cabling provides less of a fire hazard and risk, and additionally, is often less expensive to install since current license requirements do not require a skilled electrician to install Cat 5 cabling in a facility because of the low current level conducted in Cat 5 cables. This contrasts with traditional AC power that usually carries sufficient current and voltage so as to require that the wiring within a structure be installed by skilled electrician personnel.

Your attention is next directed to FIG. 12 that shows an alternate embodiment lighting system 180 of the present invention. The alternate embodiment of the present invention includes a power distribution module 182 that includes a power input source 181, for providing power to a fuse puck 184. The drivers are not contained on power distribution module 182. A Cat 5 cable 186 conducts the power from the remotely located power distribution module to the light fixture 188. The light fixture itself includes a switch 190 that is capable of selectively directing electricity to one or more of three drivers 191, 192 and 193. Each of the three drivers 191, 192, and 193 is provided for controlling the flow of electricity to LED bulbs 194, 195, 196 respectively. As with the above fixtures, bulbs 194, 195, and 196 can represent either single bulbs or alternately, gangs of LEDs that operate together.

The purpose behind the configuration shown with housing 188 is to provide three different LEDs 194, 195 and 196 that are independently controllable. Such a fixture is especially useful when the LEDs 194, 195, and 196 are LEDs having different output characteristics.

The embodiment 188 shown in FIG. 12 is especially useful when the light fixture 188 is intended to produce, lights of different colors. As most of the colors of the spectrum can be produced through a combination of red, green and blue lights, the fixture 188 shown in FIG. 12 could be capable of producing light of many colors by employing a red light 194, a green light 195 and a yellow light 196. By varying whether the lights 194, 195, 196 are on and by varying the intensity of the light output of the bulbs 194, 195, 196, one could vary the combined output from the housing 188. Since LEDs are dimmable, and since drivers 191, 192 and 193, along with switch 190, are capable of not only turning the lights on and off, but making the lights dimmable, one can employ a light fixture similar to 188 to create a myriad of different colors to enable the user to achieve different effects.

Not only can a RGB color scheme be used, but also a RGBW, that is a four LED array wherein the colors red, green, blue and white are employed. Alternately, other color schemes and the like are useable dictated primarily by the availability of acceptable LED types, and the user's imagination. Another LED arrangement might be a two LED array, where a first LED is a "cool white" and a second LED is employed that is a "warm white", so that for example, the user may adjust the LED output of the light fixture to have a warm (red biased) light output similar to that produced by an incandescent bulb, or alternately, a cool (blue biased) white light that is similar to that produced by a fluorescent bulb.

As shown in FIG. 12, DC voltage in is provided to the power distribution module 182. The voltage directed in is passed through a fuse and communications puck 184 that is placed on the power distribution module 182 at the same place that one would otherwise place a driver. The primary function of the fuse puck 184 is to ensure that regulated power is transmitted between the power distribution module 182 and the light fixture 188. Such regulated power is preferred over unregulated power, since it tends to increase the safety of the device by preventing undesired power spikes, and also, from a "code enforcement" standpoint, helps to ensure that the power being delivered to the light fixture is within code guidelines such as Class 2 guidelines that enable one to use a cabling such as Cat 5 to wire a house, without having an electrician's license.

The current that emerges from the fuse puck 184 is transmitted over a Cat 5 cable 186 to the light fixture 188. Within the light fixture 188, is a switch 190 that controls the operation of at least one or more drivers 191, 192 and 193. In the figures shown, three drivers, 191, 192 and 193 are shown. First driver 191 is provided for providing a conditioned, constant current output to first LED 194. Second driver 192 is provided for providing a constant current output to second LED 195. The third driver 193 is provided for providing a conditioned, constant cut rent output to the third LED 196 to ensure that the power that is delivered to LED 196 is a constant current power. Along with power being transmitted along the Cat 5 cable, data is also transmitted between the components of the light fixture 188 and the power distribution module 182, preferably in both directions.

In a preferred embodiment, the cabling 186 between the power module 182 and the light fixture 188 is a multi-stranded, electrical cable. An example of a multi-stranded electrical cable is a Cat 5 cable. Cat 5 cable includes eight wires. In order to ensure that sufficient power is transmitted to the light fixture; the power is transmitted over four of the 24-22 gauge wires within the Cat 5 cable 186.

Two additional wires within the Cat 5 cable are used for the transfer of data, with the final two wires being used to send conditioned and regulated 12 v power. The data being transferred between the power distribution module 182 and the switch 190 is data that is employed by the switch 190 to determine which of the three drivers 191, 192, 193 to "turn on" to permit the drivers 191, 192, 193 to conduct power to the respective LEDs 194, 195, 196.

This data wire pair is simultaneously used to read a thermistor 197 which is a resistor that changes resistance based on temperature change. The thermistor 197 is placed in a position on the fixture to measure the temperature of the LED array 194, 195, 196. The measured temperature may be used by the driver module 191, 192, 193 to reduce output levels if the temperature were to exceed an adjustable threshold set point.

Turning now to FIG. 14, a system 250 of the present invention is shown that includes a power distribution module 52, along with three various output members, including externally switched LED devices 264, internally switched and driven LED devices 268, a motor 274 for operating a device, such as a curtain or blind opening device 272. Additionally, an input device, such as a switch 253 is provided for imputing information into the power distribution module 252 for distribution to the external devices, such as the LED array 264, 268 and motor array 272.

There exist four sets of external cables that lead away from the power distribution module 252.

These external cables include a fist set of cables 260 that are coupled by an RJ45 jack to a plug array 257 that is coupled to or electrically connected to the power distribution module 252. A second set of cables 258 are connected by a plug 257 to the power distribution module; a third set of cables 260 is coupled by plug 261 to the power distribution module 252 and a fourth cable 262 is coupled by a fourth plug 264 to the power distribution module 252.

The plugs and cables described above are best shown with respect to FIG. 13. FIG. 13 shows an exemplary Cat 5 type cable 288.

A plug (or socket) member 290 is placed at a terminus of the cable 288. The plug or socket is known as an RJ45 jack, and is quite commonly used in Ethernet connections. Within the cable are four pairs of wires, including first pair of wires 300, second pair of wires 302, third pair of wires 304 and fourth pair of wires 306. A plastic shield 296 encases the wires internally to protect them from harm and shorting out.

Returning back to FIG. 14, the first external device 264 comprises an externally switched LED array wherein the device includes a switch 266 that is provided for controlling: the operations of drivers 265 that are provided for controlling the operation of LEDs 267. The external switched LED array 264 is similar in many ways to the device shown in FIG. 12, and discussed above. A Ca 5 cable, such as Cat 5 cable 288 includes four pairs of twisted together wires through which power or data can be conveyed between the power distribution module 252 and the driven device 264. Because of the power requirements of the LEDs and the drivers, the Applicant has found that the operation of the device is best served when two pairs 308, 310 of twisted wires are used to power the drivers 265 and. LEDs 267. A puck containing fuse 316 is placed in the power distribution module to ensure that regulated smooth power is conveyed through the plug 257 and the external wires of the Cat 5 cable. The third pair of wires 312 is used to convey data to switch 266 to tell the switch 266 how to operate the drivers 265 and hence, lights 267. The fourth pair of wires 314 is employed for providing power to the switch to operate the switch.

TABLE 1

| RJ45 PIN | EIA/TIA 568B Color | Purpose | Notes |
|---|---|---|---|
| 1 | White-Orange | Kpd Power+ | Keypad/Sensor Power (either adds DC+) |
| 2 | Orange | Kpd Power− | Keypad/Sensor Power (either adds DC+) |
| 3 | White-Green | Data A/ Sensor | RS485 data/Thermistor (either adds DC+) |
| 4 | Blue | LED Power+ | 0-60 V DC, Max 120 W |
| 5 | White-Blue | LED Power− | 0-60 V DC, Max 120 W |
| 6 | Green | Data B/ Sensor | RS487 data/Thermistor (either adds DC−) |
| 7 | White-Brown | LED Power+ | 0-60 V DC, Max 120 W/Gnd |
| 8 | Brown | LED Power− | 0-60 V DC, Max 120 W/Gnd |

The internally driven LED 268 also includes a first and second pair of wires 320, 322 for providing power to operate the LED light 269. The driver 328 is placed on the power distribution module, as placing it there is more convenient and less costly than placing it in the fixture, such as is performed with remotely switched and driven LED 264.

The third and fourth pairs of wires 324, 326 are not shown as having any designated purpose. However, one or both of the pairs of wires 324, 326 could be coupled to a second driver (not shown) and a second remotely driven LED (not shown). Alternately, the third and fourth pair of wires 324, 326 could be coupled to one or two switches or sensors for receiving information from a remotely disposed sensor or switch.

The motor device 272 is provided for operating something that requires a motor to drive it. An example of a motor driven apparatus is a set of blinds or curtains that cover a window. Additionally, other various motor-driven items could be coupled by the CAT 5 cable to the power distribution module 252. The particular motor array 272 includes a motor 274 that includes an output shaft 278, for turning the device such as an input shaft or gear box that needs turning or moving. The first and second pairs of wires 336, 338 are provided for powering the motor. A fuse puck 321 is provided for conditioning the power, and preventing the motor 272 from burning out.

The fourth cable 262 is directed to a switch 253. In contrast to the other three external devices, the switch 253 provides information into the power distribution module 252. Although a single line 262 is shown as being directed from the switch to the plug 263, it will be appreciated that a Cat 5 cable will likely be used because of convenience.

The first line into the switch puck 332 can be provided for conveying data into the switch puck and a second line 348 can be provided for providing power to the switch 253. The switch 253 can also have an output 349 to convey information from the switch 253 to the appropriate other member within the power distribution module 252 whose operation is governed by the switch input.

The same general protocol used in connection with the device 180 of FIG. 16 can also be employed when one is operating an electrically controlled apparatus other than an LED light. For example, as best shown in FIG. 14, the device and its power distribution module 252 is being used to control the operation of a motorized blind system 272, along with the pair of LED arrays 264, 268. The motorized blind system includes a motor 274 that provides power to an output shaft 278 to open and close the blinds (not shown), or raise and lower the blinds as so desired. In addition to the motor 272, a motor control unit 280 is provided that communicates with the motor, to tell the motor 274 when to turn on and off and what actions for the motor 274 to perform.

Voltage comes into the power control module 252 and is directed to a fuse puck 321. The current that emerges from the fuse puck 321 is conditioned current. This conditioned current is then delivered to the motor 272, to provide power for the motor 272 to move as dictated by the motor control 280. When using a Cat 5 cable, because of the smallness of the wires, (typically 24 gauge) two pairs of wires 336, 338 should be employed for carrying the current from the fuse puck 321 to the motor.

An additional wire pair 340 is used to carry data between a switch 280, which can control the motor 274. An external motor control (not shown) can transmit data via wire pair 340 to switch 280 to turn the motor on or off to thereby control the operations of the blinds.

As mentioned above, there is a wire pair 324 in an 8-wire Cat 5 cable 256 for which no purpose has been designated. This additional pair of wires can be used to transmit data between the power control module 252, or some other control, and a particular remote device. For example, a light sensor may be coupled to the LED light, to detect the presence of light or the lack of presence of light at the LED light.

This information that is determined by the light determining sensor (not shown) might be used for purposes such as determining whether the LED 269 is functioning properly, or alternately, may be used as a darkness detecting sensor for turning the light 269 on in response to it becoming dark outside. Alternately, a sensor such as a motion sensor could be placed adjacent to the light 269, with data being transmitted between the power distribution module 252 and the motion control sensor (not shown), so that the motion control sensor could sense the presence of motion, and through a control system, cause the light to turn cm in response to this perceived motion.

Distribution of Power and Data on the Power Distribution Module

The power distribution module includes, among other things, communication channels for enabling components on a power distribution module to distribute power, data or other materials or information to other components on the power distribution module, and also includes output components.

The distribution portion of the power distribution module includes one or more modular switches that are attachable to jacks or plugs to R45 jacks on the power distribution module. Power or data is conducted into the switch module. The output of the switch module is connectable to one of a plurality of different channels. In a most preferred embodiment, a 16 channel output scenario is used. A 16 channel output comprises 16 output ports. The output ports functionally define 16 different information paths within the power distribution module through the use of a bridge between the output of the switch and a 16 output header juniper, that is preferably disposed alongside the R45 jack in which the module is plugged.

The user can select the particular channel to which connect the bridge. For example, if the user connects channel five of the 16 option output header, a bridge could be formed to extend between the output of the switch and the input pin of the 16 option input header for channel five.

Channel five would then be placed in a communicative relationship with one or more drivers. The drivers are also attachable to the power distribution module by an R45 jack. Additionally, 16 option pin headers are disposed adjacent to the drivers that are coupled to the RJ45 jacks. A bridge is then employed to connect one of the pins that relate to a particular channel of the 16 option channel to couple the appropriate pin with the driver. Following on with the example above, if one desired to have the particular switch described above that was coupled to the "input of channel five", one would desire to couple the driver to bridge the output of channel five.

More than one driver can be coupled to channel five to any other desired channel). Imagine for example, that three different drivers are coupled to the output of channel five. If this were occur, power or data that was input into the switch that was coupled to the input of channel five would then be distributed to each of the three drivers connected to the output of channel five. The drivers would then receive the information or power that was transmitted through channel five, so that the drivers could condition the power or data as appropriate, to provide constant current output, or an appropriate, data output.

The power and/or data from the output of the driver would then be communicatively coupled to an output port, such as a Cat 5 jack output port. A suitable transmission cable, such as Cat 5 cable, would then transmit the power or signal from the output jack of a power distribution module, to the device to be powered, such as a light fixture, sensor, motion detector, or motor for blinds, just to give a few examples. Therefore, when one decided to transmit power or data to the switch coupled to channel five, such as by turning on a light switch, the turning on of the light switch would cause power to be transmitted to the switch. From the switch the power is distributed to the three modules connected to channel five and ultimately from the drivers that receive the panel out to the three LEDs that were coupled to the output of the three drivers coupled to channel five.

As discussed above, the eight cable (four wire pair) arrangement of a Cat 5 cable enables different information streams to be carried between an upstream switch or control member, such as a keypad, and a downstream output device, such as a light or sensor. For example, in the situation discussed above wherein the light had a sensor, data could be transmitted between the sensor, the drivers, back to the switch and then ultimately back to a control member that would receive the information about the conditions sensed by the sensor. In the above-described multi-color light (e.g. 264), the light switch fixture that was coupled to the driver will receive electricity to power the three LED array. Additionally, the driver will receive information so that the switch within the light fixture that controlled the operation of the three LEDs will receive appropriate information to control the three LEDs appropriately.

The reader's attention is now directed to Exhibit C which is attached hereto and is made a pan of this patent application, as the material set fourth below can best be understood with reference to Exhibit C.

To better understand the invention, it is helpful to summarize and describe some of the primary components that are used in connection with the present invention. These devices are described in more detail in Exhibit C attached hereto and is made a part of this patent application by being incorporated herein.

A primary component of the system is the Power Distribution Module. The Power Distribution Module connects up to 16 puck devices to RJ45 connection ports. The puck devices can be items such as LED boost pucks, buck pucks, switch pucks, smart SIB pucks and more. Expansion ports allow up to 48 lights per channel. Typically, the Power Distribution Module will include 16 channels.

A Power Management Module provides over current protection to up to six Power Distribution Modules. The Power Management Module also monitors the energy consumption of the Power Distribution Module to the batteries. The Power Management Module is used primarily used on devices that include an AC supply functionality.

A smart switch puck is a device used in the application that reads input signals via the Power Distribution Module port Cat 5 connection and produces an LED control channel signal. Each smart switch puck can control up to 48 LED pucks. Switch types include normally open, normally closed, momentary open, momentary closed and variable dimmer. Switch pucks with the same ID work as three-way and multi-way switches. Additionally, switch pucks can be controlled via mini-brains, ImPucks, or main brain controllers. Multiple LEDs can be connected in series up to 45 volts total drop. Each LED in the series must be the same current. As such, one should select an LED puck to match the LED light current rating.

An ImPuck is also referred to as a mini-brain. The ImPuck enables Internet communicated control over the system of the present invention from any web-enabled device, such as a Smart phone, personal computer or even a third party control system. Full two-way data exchange allows you to see and control lights from anywhere where an Internet connection is available. Additional applications can be built into the electrical MP for endless opportunities.

Except as otherwise noted, LED fixtures produced according to the present invention contain only the LIED luminary and housing. Luminaries are available in a variety of sizes; colors and designs. For the reasons discussed above, the driver need not be part of the LED fixture, as the driver is generally disposed at a regional or master Power Distribution Module that controls the LED remotely via power and data sent over a Cat 5 cable from the Power Distribution Module to the LED.

It is also important to understand some of the architectural aspects of the present invention.

The present invention provides a platform that provides main power, data/signaling, and regulated 12-volt power to each of a plurality of RJ45 ports. From these ports, power and signaling can be carried to a wide array of devices, as discussed above. Because the port socket can have many modular devices inserted, the present invention can provide many methods of powering LED lights and accessories attached to the port.

Smart interface blocks are connector members that enable one to provide a connection between the LED and the fixture. The smart interface blocks of the present invention simplify breaking out the pins at the field end of the Cat 5 wire. More advanced smart interface blocks may take advantage of the data/signaling pins or have electronics in the field that are powered by the 12 Volt DC regulated KP+ and KP− pins.

Another option is to provide supply power straight to the port socket and out to the smart interface block. The smart interface block then has a full 2 amp or 40 Watt of power may and provide lighting, dimming control and optional data communication as needed. Smart interface blocks LED+/− and uses switch puck or other channel controlling port puck to control and dim the driver. Multiple fixtures can be placed in series. Once simply adds up the voltage drop across the LEDs, to ensure that the total volt is below 42 Volts.

A constant voltage puck passes power supply directly to the LED+/− pins in the port and is controlled by the channel pin at the port socket. The puck requires only two conductors for LED operation. However, with only two wires, you will lose sensor capabilities, LED temperature, feedback, etc. An adaptor can convert the port RJ45 to two conductors in the panel before heading to the field devices. Multiple fixtures can be placed in parallel by simply adding up the current of each fixture and keeping the total below 2 amps, or otherwise use an external booster and a wire rated to handle the power.

A control pin constant voltage puck passes supply power directly to the LED+/− pins like the constant voltage puck, but the power is not interrupted at the Power Distribution Module port for dimming and on/off like the constant voltage puck. Instead, the control pin constant voltage pock sends a control signal over an additional wire (pin 3 and optionally pin 6). This keeps the power width modulation LED signal wire short for low EMR and allows many LED array combinations to pass UL tests more easily. It also allows higher current LED arrays because the current is only between the LIED controller and the smart interface blocks in the LED array.

The DMX/DALI+ power smart puck passes supply power directly to the LED pins like the control pin constant voltage puck, but uses DMX/DALI or Lumencache port protocol (LPP) to communicate one or two way to the fixtures attached. LED power can be sourced locally at the smart interface blocks from an external power supply (or via heavier gauge wire from the Power Management Module).

DMX is a standard for digital communication networks and are commonly used to control stage lighting and effects. It was originally intended as a standardized method of controlling light dimmers that prior to DMX had employed various incompatible proprietary protocols. Currently, it is the primary method for linking controllers and dimmers, and also more advanced fixtures and special effects devices such as fog machines and moving lights, and has expanded to uses of non-theatrical interior and architectural lighting. DMX is also as DMX 512.

DALI is an open standard for digital control of lighting. DALI is a protocol that has been adopted by several manufacturers in their product offerings.

A DALI network consists of a controller in one or more lighting devices, such as electrical, ballasts and dimmers that have DALI interfaces. The controller can monitor and control each light by means of a bi-directional data exchange. The DALI protocol permits devices to be individually addressed as it also incorporates group and scene messages to simultaneously address multiple devices. Each lighting device is assigned a unique static address in the numeric range of 0-63 making possible up to 64 devices in a stand alone system. Alternatively, DALI can be used as a sub-system via DALI gateways to address more than 64 devices. Data is transferred between controller and devices by means of Asynchronous, half-duplex serial protocol over two wire differential bus with a fixed data transfer rate of 1200 bits per second. More information about DALI can be found at www.dali-ag.org.

Basics:

LED luminaries (light chips) require constant current power to operate without damaging, the diodes. This driver (e.g. 328), can be located at a distance from the light fixture (e.g. 269) so the device of the instant invention places them in centralized and easily accessible lighting panels. Standard Cat 5 or Cat 6 wire is used to send LED power from the driver (e.g. 269) to the LED Array (typically 1 LED but can be a string of up to 20 LEDs until the maximum voltage drop is reached). Other configurations are also possible for high power or color-changing LED lights (e.g. 267), motorized shades (e.g. 268), and fans.

Because of the extremely low power requirements of LEDs, only two pairs of wires in the Cat 5 cabling are needed for transmitting electrical power sufficient to power the LED. With the extra two pairs of wires in the Cat 5, the present invention provides command/control data communications and regulated power to devices attached along the Cat 5 wires. These devices include such things as sensors, keypads, indicators, switches, and more. Each Cat 5 cable from the panel can include Data, Sensor/Keypad Power, and either LED Power from a Driver or Fused Power from the large DC power source. Smart Interface Blocks (SIBs) simply fixture installation.

All electronic components use DC power internally so the present invention typically includes one large AC/DC power converter that also charges a battery. Thanks to the battery buffer, interruptions in the AC power supply from the utility grid do not affect the operation of the system, until the battery level drops below a preset point. This battery buffer also protects the system from sags, surges and variations in the grid-delivered power.

Wiring:

The Power Distribution Module connects the field Cat 5 wiring from the Field Devices (e.g. Lights, Switches, Keypads, Sensors, etc) back to 16 Ports to which the Cat 5 cable connects. The Cat 5 ports are RJ45 jacks and the Cat 5 is typically wired in the standard TIA-568B configuration (While/Orange, pin 1). Field Devices may have an RJ45 tip or a convenient tool-less connector. A Wire Adapter can attach Port Cat 5 wires to other wire types.

Depending on the type of field devices connected to the Port, specific. Pucks are connected to the matching 16 Puck Ports. For example, if a switch is connected to the wire connected to Port one, then a Switch Puck would be inserted in the Puck Port 114 pin connector. A Switch Puck reads the switch in field, and produces an ON/OFF or dimming Channel Signal. There are 16 Channels on each Power Distribution Module that are shared at each Puck Port. A jumper selector chooses which Channel the Puck Port is transmitting on or receiving on.

A Driver Puck will produce regulated power to the attached LED Array in the field. Driver Pucks listen to their selected Channel signal (i.e. from a Switch Puck) as selected by the jumper, and turn on/off or dim their attached LED.

Up to 48 Driver Pucks can listen to the same Channel and be commanded by a single Switch Puck. The 16 Channels are extended to the Power Distribution Module Expansion Bus at the top and bottom of each Power Distribution Module. Connecting the Power Distribution Module Expansion Bus cable will allow additional Power Distribution Module Ports to listen to the same 16 Channels. At any point, the Expansion Bus may be split, by omitting the expansion cable, and a new 16 Channels are available starting with the next Power Distribution Module.

The LC-Bus allows communication between Smart Pucks and any top level control interfaces connected via the Comm Bus ports. All LC-Bus devices should be connected to allow communication between each other. This includes Power Distribution Modules, Power Management Modules, and Main Brain modules. Mini Brain modules connect to Power Distribution Module and Power Management Module ports.

ID Configuration:

Each LC-Bus supports up to 65,000 Device IDs. IDs should be assigned to each Smart Device such as Switch Pucks. When two or more Switch Pucks have the same ID, they will all act together as one. Brain interfaces can quickly assign IDs or IDs can be assigned using a manual mode.

Control:

Brain Modules provide the automation and interface to other control systems. The Mini Brain provides RS232 and IP interfaces to the LC-Bus and is typically used to interface the instant invention's devices to other control systems such as Savant, Crestron, Control4, HAI, RTI, AMX, in addition to Smart Meter HANs, and the included simple browser interface. ImPuck adds Electric imp cloud access and IP connections.

A Main Brain Module allows the connection of more than one LC-Bus into a larger network via the Main Brain Ethernet port. This allows very large scale networks to be created with distributed automation and control processing to ensure sufficient communication speeds are maintained.

It is highly useful to use the Behavior layers of the controls to optimize the system in large networks. This feature distributes the processing so the complete system is more fault tolerant and "intelligent".

Turning first to FIG. 15, the connectivity of the highly modular grid platform 400 of the present invention is shown. The main power goes into the system through main power line 410, and is passed through a 12 volt DC regulator 402, and a port socket 404. The port socket 404 communicates with a multiplexer/selector 406. The port socket 404 also connects to a port connector 408. The port connector 408 enables current to pass there through. Several channels of current can pass there through including 12 volt regulated power, switched regulated power and port communication bus information.

port 432 to device 434 connector is referred to herein as a smart interface block 430. As shown in FIG. 16, the smart interface block 430 includes a port connector 432 and a device connector 434. Device connectors connect to and use a 12 volt regulated power, switch regulated power and port communications bus.

Port sockets 404 (FIG. 15) may support many configurations of pucks in the standardized header. Most socket pucks will convert or condition the main power input 410.

Additionally, most socket pucks will send or receive analog, digital or serial data signals across multiplexed channel pins of the multiplexor selector 406. Further, most socket pucks will send or receive an analog, digital, or serial data signal across the port connector 408. Port communication bus pins 409 are typically RJ45 connector or standardized connectors for Cat 5, Cat 6 or Cat 7 wires. However, they can also be RJ 45110 punchdown 66, screw terminal, or snap retaining blocks.

Alternately, the data communication bus to the lights 409 can be used to query the devices on the Port 408 for information regarding their capabilities, requirements, and operating readings. This includes voltage and current, requirements, color level and output, model number, operating run time (at level percentages), and a globally unique ID for the bulb.

This data is used by the Puck placed in the Port Socket 404 to change the electrical function of each of the pins between the Port Socket 404 and the Port to the field devices 408. This produces a system that then automatically configures the electrical output conditions to match the field devices and enables the remaining functions of the invention to be performed.

An alternate embodiment of the micro grid platform 448 is shown in FIG. 17. The embodiment of platform 448 only passes the main power 450 and the main data bus 452 into the port sockets 454. Regulated power 456 is then optionally produced in the modular port puck devices connected to the port socket 454.

Additionally, the platform 448 includes a port connector and a multiplexer selector 460 that are generally similar to their analogous components 415. Additionally, the outputs from the port connector include a 12 volt regulated power 462, switched regulated power 464, and a port communication bus 466 signal.

FIG. 18 shows a constant current LED driver 478 having an optional temperature feedback that is provided via a thermistor 482. Serial digital data may still be communicated over the port communication bus pins 480 simultaneously with analog temperature readings from the thermistor 482. The output 486 to the LED 488 is switched on and off based on the signal from the multiplexer selector pin 490. The constant current LED driver also includes a port socket 485 to which is coupled a port puck 483. The constant current LED driver circuitry 491 includes pulse width modulation circuitry within the circuit 491, to permit the driver 492 to effect dimming of the LED 488 that receives power from the LED output 486.

Turning now to FIG. 19, a constant current LED driver with communication bus connection system 496 is shown. System 486 allows the driver module 500 to be controlled via the data bus 502 and optionally reports status and conditions back across the data bus 502 to a suitable recipient. It may optionally read or write to the multiplex/selector pins 508. Other than that, the constant current LED driver with communication bus connection system 496 is generally similar to system 478, as it includes a port puck 510 and a puck socket 512, a main power in-line 518, a main output 514 that supplies power to an LED 516, and a temperature sensor thermistor 517, that can provide data into the driver relating to temperatures adjacent to the thermistor. Preferably, the thermistor is positioned close to the LED power light, so that it can report back on the temperature of the area adjacent to the light.

Further, the constant current LED driver circuitry 500 may include a pulse width modulation control for enabling the LED 516 to be dimmed by the driver.

A constant voltage LED driver system 522 is shown in FIG. 20. The constant voltage LED driver system 522 includes a port socket 524 that is coupled to a puck 526. A main power inlet line 528 is provided for conveying power to the circuitry, such as fuse or breaker 536 and switching device 538 that are disposed on the port puck 526. A multiplexer 530 is also provided, along with the main power outlet line 532 that conducts power to an LED 534.

This configuration of the system 522 passes the main power input 528 to the LED power pins 532, and ultimately to the LED 534 through some overcurrent protection device, that typically comprises a fuse or breaker 536. The output to the LED 534 is also switched on or off by a switching device 538. The switching device 538 actuates the on or off switching of the LED 534 based on the signal from the multiplexor/selector 536.

Circuit system 522 also includes a driver having pulse width modulation to permit the LED 534 to be dimmed by the circuit if so desired by the user.

Turning now to FIG. 21 a self-adjusting light power out adjustment circuits are provided wherein adjustment can occur based on supply voltage.

The feature produced by these two circuits is to produce a control loop that reads the main power level low and high averaged extremes, and produces an adjustment curve to the pulse width modulation duty cycle percent. Optionally, the adjustment curve is also provided to the electrical current control output, to automatically maintain the constant light output regardless of input voltage fluctuations.

FIG. 22 shows a first alternate embodiment configuration 542 of the self-adjusting light power out adjustment circuit, wherein the Voltage Measuring device 548 is placed inside the LED driver puck 550. The driver puck combines 550 the incoming PWM signal (see 552) from the channel selector 554 with the internal adjustment.

FIG. 24 shows an alternate embodiment configuration that passes the Main Power Input 572 to the LED Power outlet 575 pins through some over-current protection device, typically a fuse or breaker 576 like the Constant Voltage Puck but sends a control signal over the Puck Communications pins 579 for a field connected device to perform the dimming. The output to the LED is switched on/off based on the control signal from the Port Communications. The Port Communications pins may be controlled by relaying the Multiplexor/Selector pin 582 through a control signal provided by signal amp 584 from the main data bus.

Having described the invention in detail with references to certain embodiments, it will be appreciated that the invention is not limited to the particular embodiments described herein but rather, many other inventions fall within the scope and spirit of claims as appended hereto.

The invention claimed is:

1. A control system for controlling the operation of at least a first and a second independently controllable LED light member, the control system comprising a. a frame member on which a plurality of electrical components can be mounted, b. at least one input port for receiving at least one of a power source and a command signal source capable of sending a command signal to at least one of the first and second LED light members, c. a first driver member for conditioning power to deliver conditioned DC power to the first LED member, d. a first driver to frame connector for removably coupling the first driver member to the frame member, e. a second driver member for conditioning power to deliver conditioned DC power to the second LED member, f. a second driver to frame connector for removably coupling the second driver member to the frame member, g. a first external output port coupled to the first driver, h. a second external output port coupled to the second driver, i. a first multi-channel electrical conductor coupled to the first external output port for conducting conditioned DC current to the first LED light member; and j. a second multi-channel electrical conductor for conducting conditioned DC current to the second LED light member.

2. The control system of claim 1 further comprising a socket for receiving a plug coupled to the at least one of the power source and command signal source.

3. The control system of claim 1 wherein the first LED light member is different in output and current draw from the second LED light member, and the first driver member is configured to condition power to provide conditioned DC current appropriate for the output and current draw of the first LED member, and the second driver member is configured to provide conditioned DC current different than the first driver member, and appropriate for the second LED light member.

4. The control system of claim 3 wherein the first and second driver members each include pulse width modulation circuitry for permitting the first and second LED light members to be controllably dimmable to provide varying light outputs.

5. The control system of claim 3 further comprising a first sensor positioned for sensing a condition in an area under the influence of the first LED member, wherein the first sensor is communicatively coupled to the first multi-channel electrical conductor for sending a signal relating to the sensed condition to the first driver.

6. The control system of claim 5 wherein the first sensor is selected from the group consisting of a temperature sensor, a motion sensor, a light sensor, a weight sensor, a time sensor pressure sensor, light input sensor, light color sensor, speech, camera, audio sensor, distance sensor, power monitor sensor, vibration sensor, proximity sensor, data sensor, and an identification indicia sensor.

7. The control system of claim 6 further comprising a data processor for processing information sensed by the first sensor, and for sending a command to adjust operational parameters of the first LED light member.

8. The control system of claim 1 wherein the command signal source comprises a data processor coupled to the at least one input source, the command signal source having an input device for permitting a user to input a command to the command signal source.

9. The control system of claim 1 wherein the command signal source is selected from the group consisting of computers, telephones, PDAs and keypads.

10. The control system of claim 1 wherein the frame connector includes a port socket to which at least two electrical components can be coupled for facilitating communication between the components.

11. The control system of claim 10 wherein the driver is coupled to the port socket, and the port socket is in communication with a power source and a multiplexer for providing a multi-channel output to the first LED light member, inducting a first channel of regulated DC power, and a second channel of switched regulated power.

12. The control system of claim 10 further comprising a remote sensor communicatively coupled to the port socket and a data bus communicatively coupled to the port socket.

13. The control system of claim 12 further comprising a processor coupled to the data bus for receiving information provided by the sensor, processing the information provided by the sensor, and sending a signal to the driver to alter the output of the driver to alter the output of the LED light member.

14. The control system of claim 1 further comprising a data bus, a power bus, and a multiplexer having at least two channels of communication.

15. The control system of claim 1 wherein the driver comprises a constant current driver for providing a constant current to the LED light member.

16. The control system of claim 15 further comprising a data bus and a sensor communicatively coupled to the constant current driver.

17. The control system of claim 15 further comprising a breaker and switching device coupled to the first driver.

* * * * *